US009320667B2

(12) United States Patent
Tilk et al.

(10) Patent No.: US 9,320,667 B2
(45) Date of Patent: Apr. 26, 2016

(54) METHODS OF TRANSFERRING PATIENTS

(71) Applicant: Nottingham Spirk Design Associates, Cleveland, OH (US)

(72) Inventors: Jason Tilk, Cleveland Heights, OH (US); William Rabbitt, Chesterland, OH (US); Rebecca Blice, Akron, OH (US)

(73) Assignee: Nottingham Spirk Design Associates, Cleveland, OH (US)

( * ) Notice: Subject to any disclaimer, the term of this patent is extended or adjusted under 35 U.S.C. 154(b) by 0 days.

(21) Appl. No.: 14/724,121

(22) Filed: May 28, 2015

(65) Prior Publication Data

US 2016/0089291 A1 Mar. 31, 2016

Related U.S. Application Data

(62) Division of application No. 14/611,512, filed on Feb. 2, 2015.

(60) Provisional application No. 62/057,208, filed on Sep. 29, 2014.

(51) Int. Cl.
*A61G 7/10* (2006.01)

(52) U.S. Cl.
CPC ..... *A61G 7/1026* (2013.01); *A61G 7/1048* (2013.01); *A61G 2200/327* (2013.01)

(58) Field of Classification Search
CPC .. B65G 49/067; B65G 49/061; A61G 7/1026; A61G 7/1048; A61G 2200/327
USPC ..... 5/81.1 T
See application file for complete search history.

(56) References Cited

U.S. PATENT DOCUMENTS

| | | | | | |
|---|---|---|---|---|---|
| 3,178,732 | A | * | 4/1965 | Stibitz | 5/83.1 |
| 4,700,416 | A | * | 10/1987 | Johansson | 5/81.1 T |
| 4,872,226 | A | * | 10/1989 | Lonardo | 5/81.1 T |
| D339,771 | S | * | 9/1993 | Newman | D12/128 |
| 5,570,482 | A | * | 11/1996 | Asakawa | 5/81.1 C |
| 5,638,558 | A | * | 6/1997 | Moore | 5/81.1 T |
| 5,737,781 | A | | 4/1998 | Votel | |
| 5,890,238 | A | * | 4/1999 | Votel | 5/81.1 HS |
| D435,493 | S | | 12/2000 | Jewell et al. | |

(Continued)

FOREIGN PATENT DOCUMENTS

EP 2 415 444 2/2012

OTHER PUBLICATIONS

AirPal Lateral Patient Transfer Device Product Brief; May 28, 2014.

(Continued)

*Primary Examiner* — David E Sosnowski
*Assistant Examiner* — Myles Throop
(74) *Attorney, Agent, or Firm* — Renner, Otto, Boisselle & Sklar, LLP

(57) ABSTRACT

A method of transferring a patient from a first resting surface to a second resting surface includes inserting a corrugated sheet into a channel formed between the patient and the first resting surface, extending a portion of the sheet between the patient and the first resting surface to under the patient's feet, extending a portion of the sheet between the patient and the first resting surface to under the patient's head, and pulling laterally on the sheet to slide the sheet from the first resting surface to the second resting surface thereby transferring the patient.

26 Claims, 30 Drawing Sheets

(56) References Cited

U.S. PATENT DOCUMENTS

| | | | | |
|---|---|---|---|---|
| 6,341,393 | B1 | 1/2002 | Votel | |
| 6,374,435 | B1 * | 4/2002 | Leininger et al. | 5/81.1 HS |
| 6,378,148 | B1 * | 4/2002 | Votel | 5/81.1 HS |
| 6,675,411 | B1 * | 1/2004 | Javier | 5/81.1 HS |
| 6,834,402 | B2 | 12/2004 | Hanson et al. | |
| 7,114,203 | B2 | 10/2006 | Lloyd et al. | |
| 7,458,113 | B2 | 12/2008 | Milam | |
| 7,506,387 | B1 | 3/2009 | Scordato et al. | |
| 7,571,498 | B2 | 8/2009 | Jewell et al. | |
| 2002/0029418 | A1 * | 3/2002 | Votel | 5/81.1 RP |
| 2003/0074732 | A1 * | 4/2003 | Hanson et al. | 5/81.1 R |
| 2005/0177942 | A1 * | 8/2005 | Finn | 5/499 |
| 2009/0045383 | A1 * | 2/2009 | King et al. | 254/93 HP |
| 2010/0235986 | A1 * | 9/2010 | Klyne et al. | 5/86.1 |
| 2013/0025048 | A1 | 1/2013 | Pruett | |
| 2014/0000024 | A1 * | 1/2014 | Van Loef | 5/83.1 |
| 2015/0007832 | A1 * | 1/2015 | Jensen et al. | 128/870 |
| 2015/0143628 | A1 * | 5/2015 | Fowler et al. | 5/81.1 T |

OTHER PUBLICATIONS

HoverMatt Air Transfer System User Manual; Jun. 2013.
Stryker Glide Lateral Air Transfer System Spec Sheet; 2009 (see Note 1 on p. 1 of IDS).
EZ Matt Air Assisted Lateral Transfers; Jan. 17, 2005.
Liftaem Lateral Patient Transfer Device; Jul. 9, 2014.
Sally Tube Single Patient Use Slide Tubes Brochure (see Note 1 on p. 1 of IDS).
The Pink Slip Slide Sheet, Product Information (see Note 1 on p. 1 of IDS).
Ayala, Heidi, et al., "Minimizing Collateral Damage: Reducing the Risks Associated with Patient Handling"; Air-Assisted Lateral Patient Transfer; Jan. 2010.
TotalCare Bariatric Plus Hospital Bed Brochure; Aug. 8, 2013.
Camtec Care Chair Manual; Apr. 3, 20016.
"Health and Economic Benefits of Improving Mobility for the Bed-ridden Patient at Home"; Next Health Inc., AgileLife Patient Transfer System; May 2011.

* cited by examiner

METHODS OF TRANSFERRING PATIENTS

FIELD OF THE INVENTION

The present disclosure relates generally to the field of medical devices. In particular, the present disclosure relates to a patient transfer assembly.

BACKGROUND

According to the recent data from the United States Bureau of Labor Statistics, health care workers suffer injuries and illnesses at nearly twice the national average rate. Hospitals had an incidence rate of 6.8 nonfatal occupational injuries and illnesses per 100 full-time workers in 2011, compared with 3.5 per 100 in all U.S. industries combined. Nearly 50 percent of the reported injuries and illnesses among nurses and nursing support staff in 2011 were musculoskeletal disorders. Nursing assistants suffered more of these disorders in 2011 than any other occupation, while registered nurses ranked fifth.

A significant part of the problem is that health care workers at hospitals, nursing homes, and home care programs face the challenge of moving partly or completely incapacitated patients. A typical patient weighs between 100 and 200 pounds, although many others weigh more. Consequently, moving a patient often requires two, three or even four health care workers. Current healthcare guidelines typically recommend that four health care workers participate in a patient transfer. These activities often create unacceptable risks of injury regardless of the number of health care workers involved in the patient transfer. The risks are even higher when a sufficient number of workers is not available to assist in a patient transfer. The costs of these injuries are significant. For example, injuries to workers' backs account for approximately 50% of worker's compensation costs for work place injuries in the health care industry in the U.S. Thus, back injuries to health care workers are a particularly vexing problem.

Patient transfer devices have been proposed to deal with the problem. Prior art devices, however, have shortcomings. In some proposed devices, the surface on which the patient rests does not cooperate or opposes the transfer because of friction, etc. Other times, the means (e.g., hospital sheets) for engaging the patient for movement are not effective or difficult to engage. The devices proposed in U.S. Pat. Nos. 6,378,148 and 6,834,402, for example, have bases that are generally too big and protrude forward too far. Therefore, the devices cannot be wheeled close enough to the resting devices to be effective. Other devices are designed to pull at locations on a sheet on which the patient rests. In some of these devices, however, the sheet, pulled at discrete locations, may wrinkle up and slide out from under the patient providing ineffective patient transfer. In yet other devices, slack on the belts or straps that pull on the sheet causes the motor or driving mechanism to "jerk" the patient when picking up the slack, which may be uncomfortable. Also, having to wait for the slack to be taken up increases the time that it takes to transfer the patient because taking up the slack increases the time for actual patient transfer to begin.

SUMMARY OF THE INVENTION

The invention relates to devices, systems and methods to assist in moving patients who are partly or completely incapacitated. The invention more particularly relates to devices, systems and methods that give a single health care worker the ability of moving a patient from one bed to another bed, between a bed and a cart or gurney or repositioning the patient within a bed regardless of the weight and/or size of the patient.

These and further features of the present invention will be described with reference to the attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the terms of the appended claims.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1:
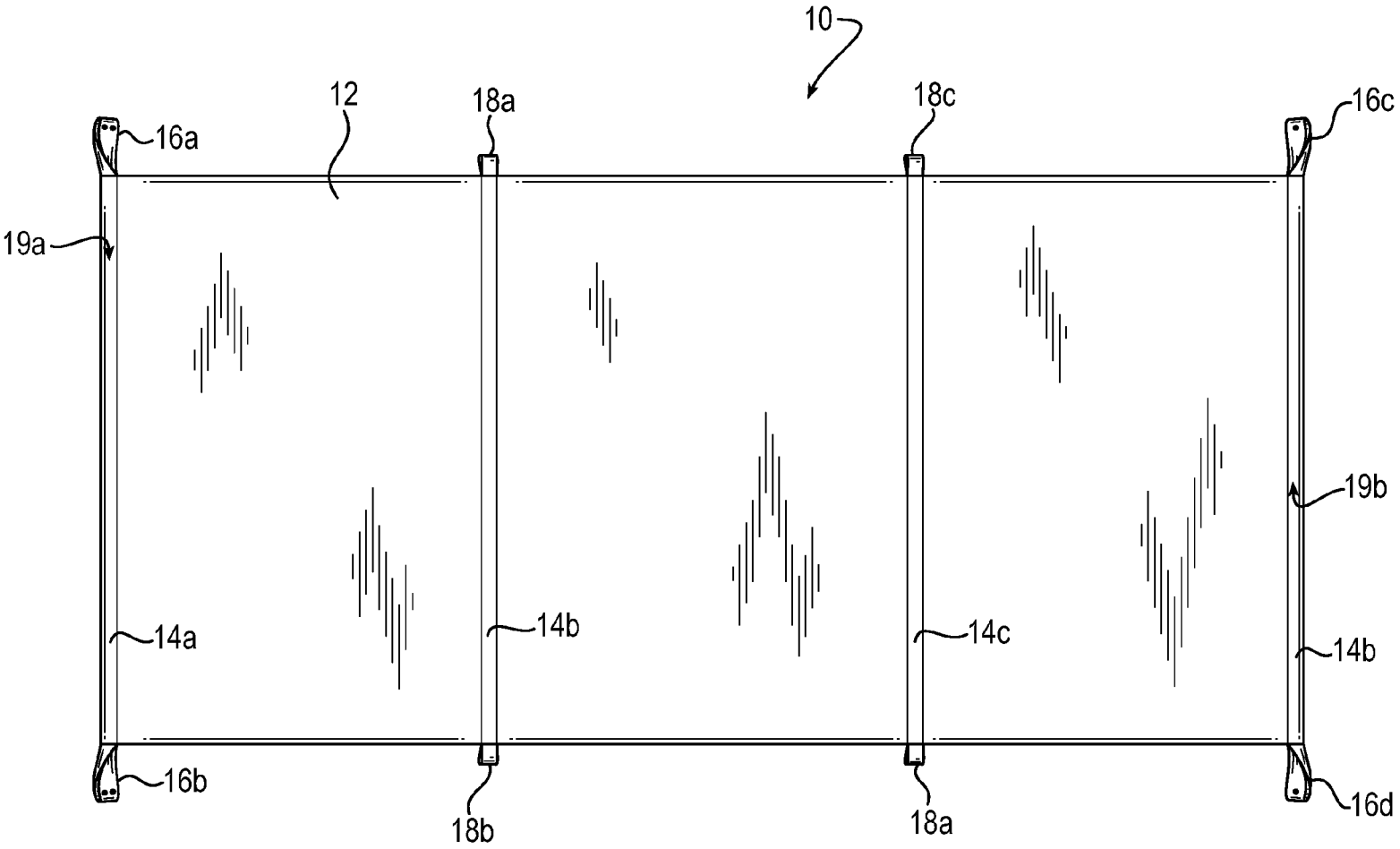
FIG. 1 illustrates a top view of an exemplary patient transfer assembly.

FIG. 1 illustrates an exemplary patient transfer assembly 10. As explained below, the patient transfer assembly 10 is insertable under a patient resting on a surface so that the patient may be easily transferred from that surface. The patient transfer assembly 10 includes a sheet 12 that is constructed of a material that has a relatively low coefficient of drag or friction (i.e., the material is slippery) and that is foldable or corrugatable. For example, the sheet 12 may be constructed of nylon, silicon coated nylon, Tyvek®, etc.

In the illustrated embodiment, the patient transfer assembly 10 includes webbings or straps 14*a-d* spaced over the length of the sheet 12. The straps 14*a-d* may be attached (e.g.

sewn) to the sheet 12 to reduce friction. The patient transfer assembly 10 also includes handles 16*a-d* connected to the ends of the sheet 12 or to ends of the straps 14*a* and 14*d* as shown in FIG. 1. The patient transfer assembly 10 further includes fasteners 18*a-d* connected to the sides of the sheet 12 or to ends of the straps 14*b* and 14*c* as shown in FIG. 1.

Figure 2A:
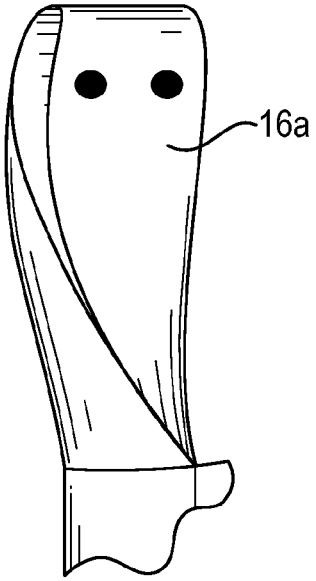
FIGS. 2A and 2B illustrate perspective views of exemplary handles of the patient transfer assembly of FIG. 1.
Figure 2B:
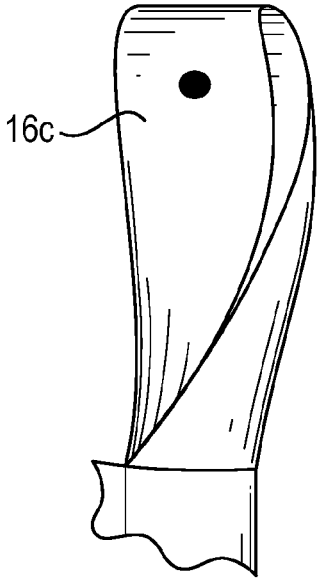
Figure 3:
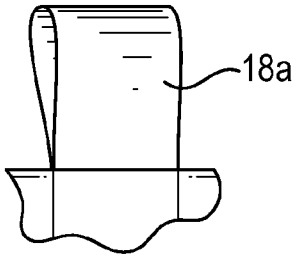
FIG. 3 illustrates a perspective view of an exemplary fastener of the patient transfer assembly of FIG. 1.

FIGS. 2A and 2B illustrate exemplary handles 16*a* and 16*c*, respectively. In the illustrated embodiment, the handles 16*a-d* are shown as loops, but the handles 16*a-d* may correspond to handles other than loops. FIG. 3 illustrates exemplary fastener 18*a*. In the illustrated embodiment, the fasteners 18*a-d* are shown as loops, but the fasteners 18*a-d* may correspond to fasteners other than loops.

Returning to FIG. 1, the patient transfer assembly 10 includes stiffeners 19*a-b*. In the illustrated embodiment, the stiffeners 19*a-b* are located at ends of the sheet 12 and are inside pockets formed on the sheet 12. The patient transfer assembly 10 may include a single stiffener or multiple stiffeners. In one embodiment, a single or multiple stiffeners may be located at locations of the sheet 12 different from the ends (e.g., the middle) or the stiffeners may be non-attached or removable from the sheet 12. The stiffeners 19*a-b* may be rods or poles constructed from rigid or semi-rigid material (e.g., wood, plastic, etc.). As described in more detail below, the stiffeners 19*a-b* resist corrugation of the sheet 12 along a dimension of the sheet.

Figure 4A:
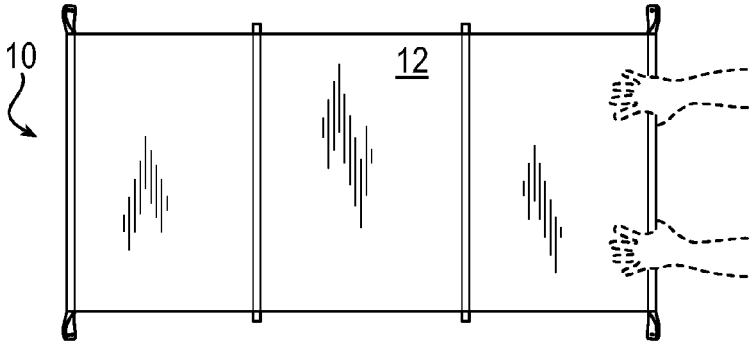
FIGS. 4A-4L illustrate an exemplary method for corrugating a sheet of the exemplary patient transfer assembly of FIG. 1.
Figure 4B:
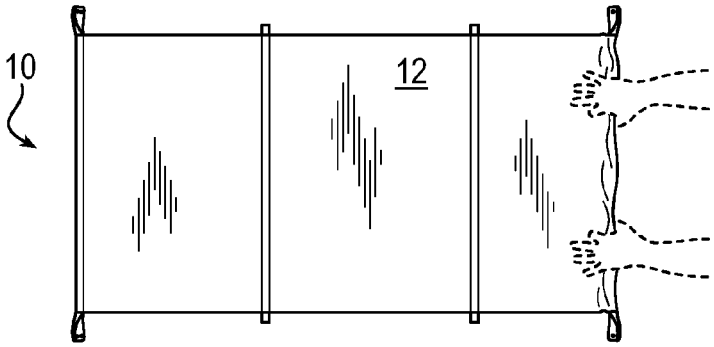
Figure 4C:
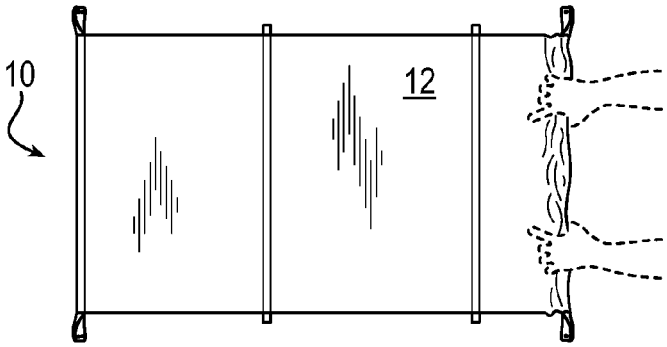
Figure 4D:
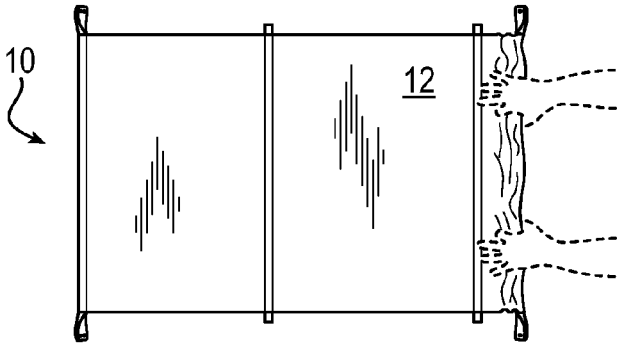
Figure 4E:
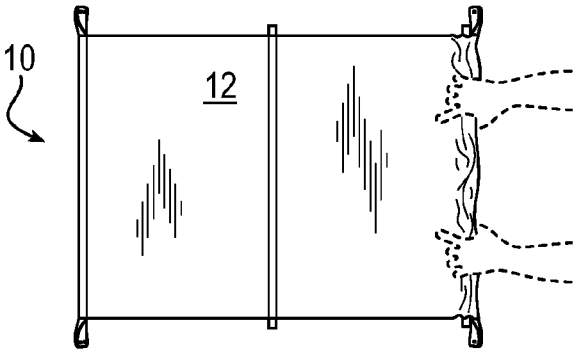
Figure 4F:
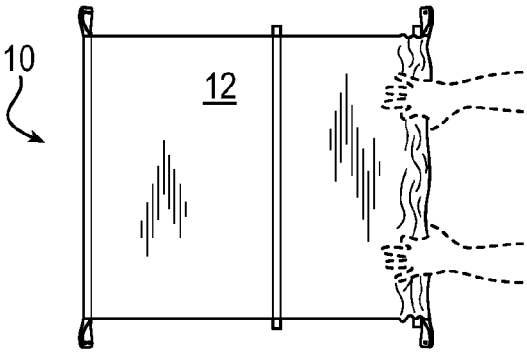
Figure 4G:
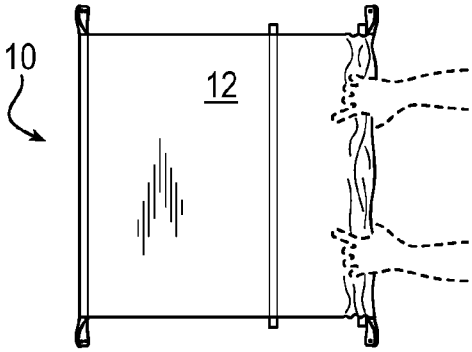
Figure 4H:
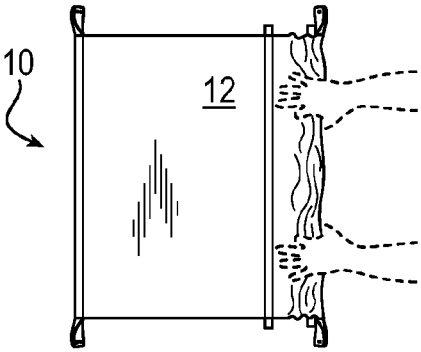
Figure 4I:
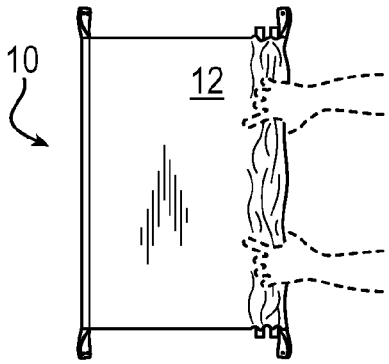
Figure 4J:
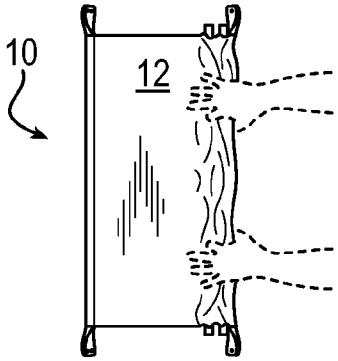
Figure 4K:
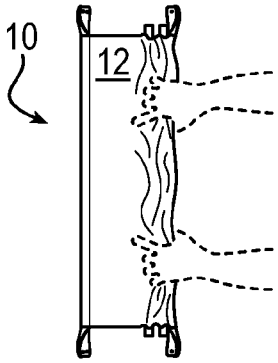
Figure 4L:
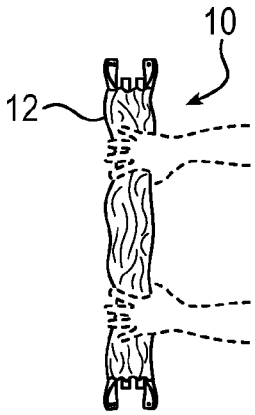
Figure 4M:
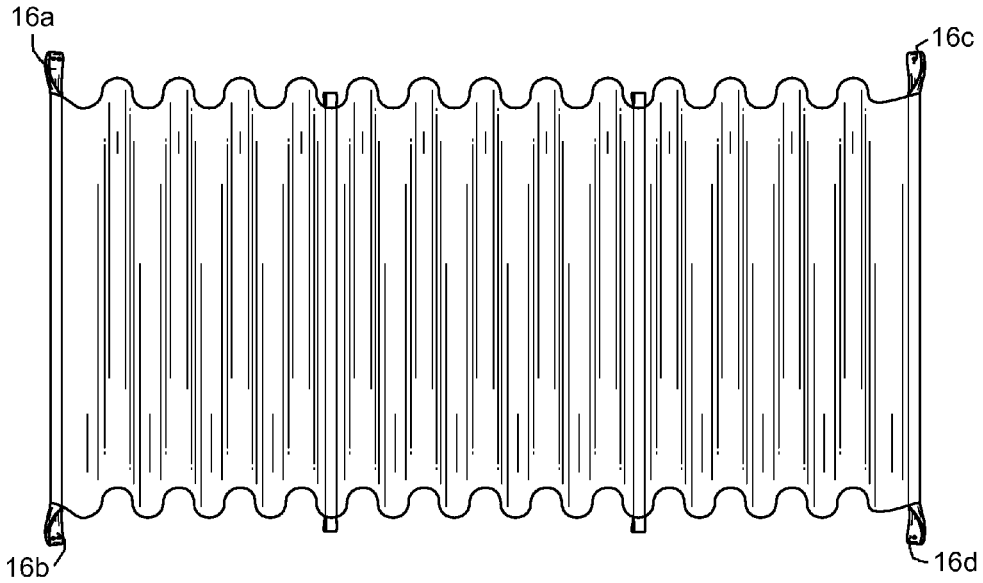
FIGS. 4M-4N illustrate exemplary corrugation methods for the corrugated sheet of FIGS. 4A-4L.
Figure 4N:
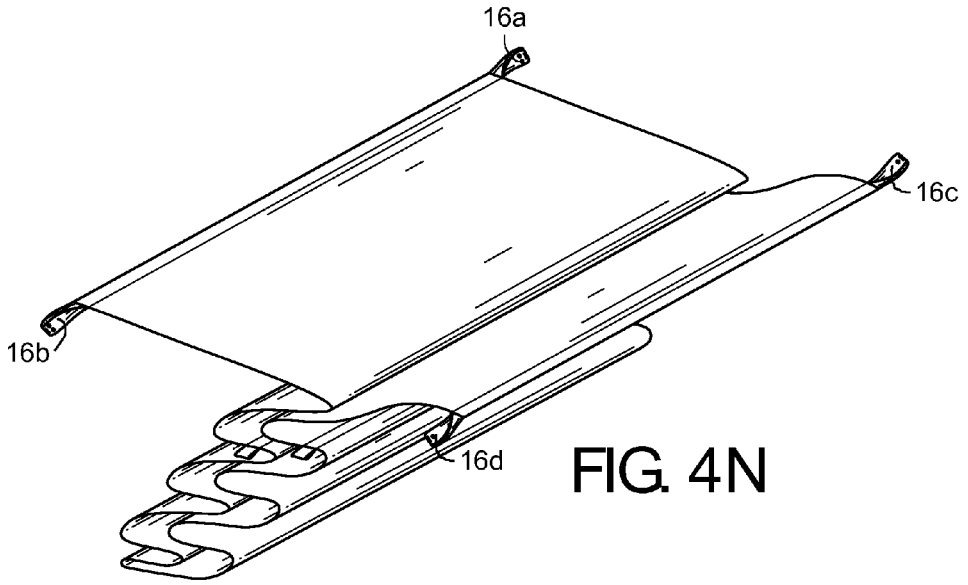
Figure 4O:
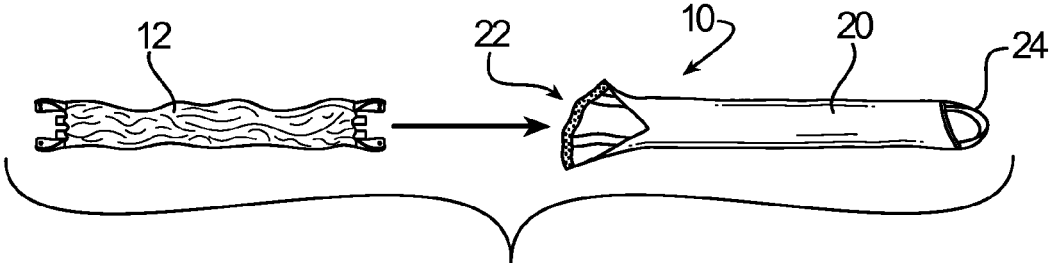
FIGS. 4O-4Q illustrate an exemplary method for inserting the corrugated sheet of FIGS. 4A-4L into a bag.
Figure 4P:
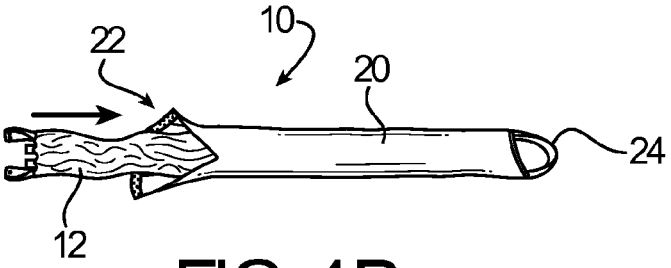
Figure 4Q:
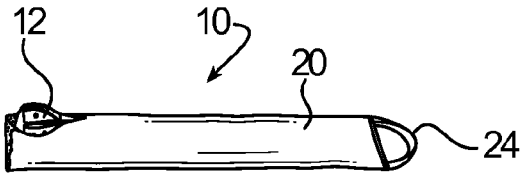

FIGS. 4A-4Q illustrate a method of preparing the patient transfer assembly 10 for use. First, the sheet 12 is corrugated by repeatedly folding the sheet 12 into a series of non-overlapping ridges and furrows. Care must be taken so that the sheet 12 is corrugated in a non-overlapping way such that the corrugated sheet 12 as shown in FIG. 4L is readily extendable under the patient as explained in detail below. FIGS. 4M and 4N illustrate two examples of ways in which the sheet 12 may be corrugated. The corrugation illustrated in FIG. 4M may be described as an accordion-like corrugation. The corrugation illustrated in FIG. 4N is another example possibility for corrugation of the sheet 12. Notice that in either example pulling of the handles 16*a* and 16*b* in a longitudinal direction away from the sheet 12 and the handles 16*c* and 16*d* in the opposite longitudinal direction effectively decorrugates or extends the sheet 12.

In one embodiment, the corrugated sheet 12 is retained corrugated by securing the sheet 12 at, for example, each end with straps (not shown) that may include a snap button, Velcro®, etc. or may simply be tied to hold the sheet 12 corrugated.

In one embodiment, the patient transfer assembly 10 is comprised of the elements described so far and used in the configuration illustrated in FIG. 4L. In the embodiment of FIGS. 4O-4Q, the patient transfer assembly 10 includes a bag 20 to store the corrugated sheet 12. The bag 20 includes an opening 22 through which the sheet 12 may be inserted into the bag 20 as shown in the progression of FIGS. 4O to 4Q. The bag 20 may also include a handle 24 to be used when deploying the patient transfer assembly 10 as explained below. Similar to the sheet 12, the bag 20 is constructed of a material that has a relatively low coefficient of drag or friction (i.e., the material is slippery). For example, the sheet 12 may be constructed of nylon, silicon coated nylon, Tyvek®, etc. In the illustrated embodiment (see FIG. 4O), the bag 20 is separate from the sheet 12 prior to insertion of the sheet 12 into the bag 20. In another embodiment (not shown), the bag 20 could be attached to or be an integral part of (integrated with) the sheet 12.

In one embodiment, single or multiple stiffeners 19 may be, instead of or in addition to at the ends or other locations of the sheet 12, attached to the bag 20. Or the stiffeners 19 may be unattached to the sheet 12 or the bag 20 and may simply be inserted in the bag 20 together with the sheet 12.

FIGS. 5A-5D illustrate deployment of the patient transfer assembly 10 to transfer a patient P who is resting on a surface S1 of a resting device D1.

Figure 5A:
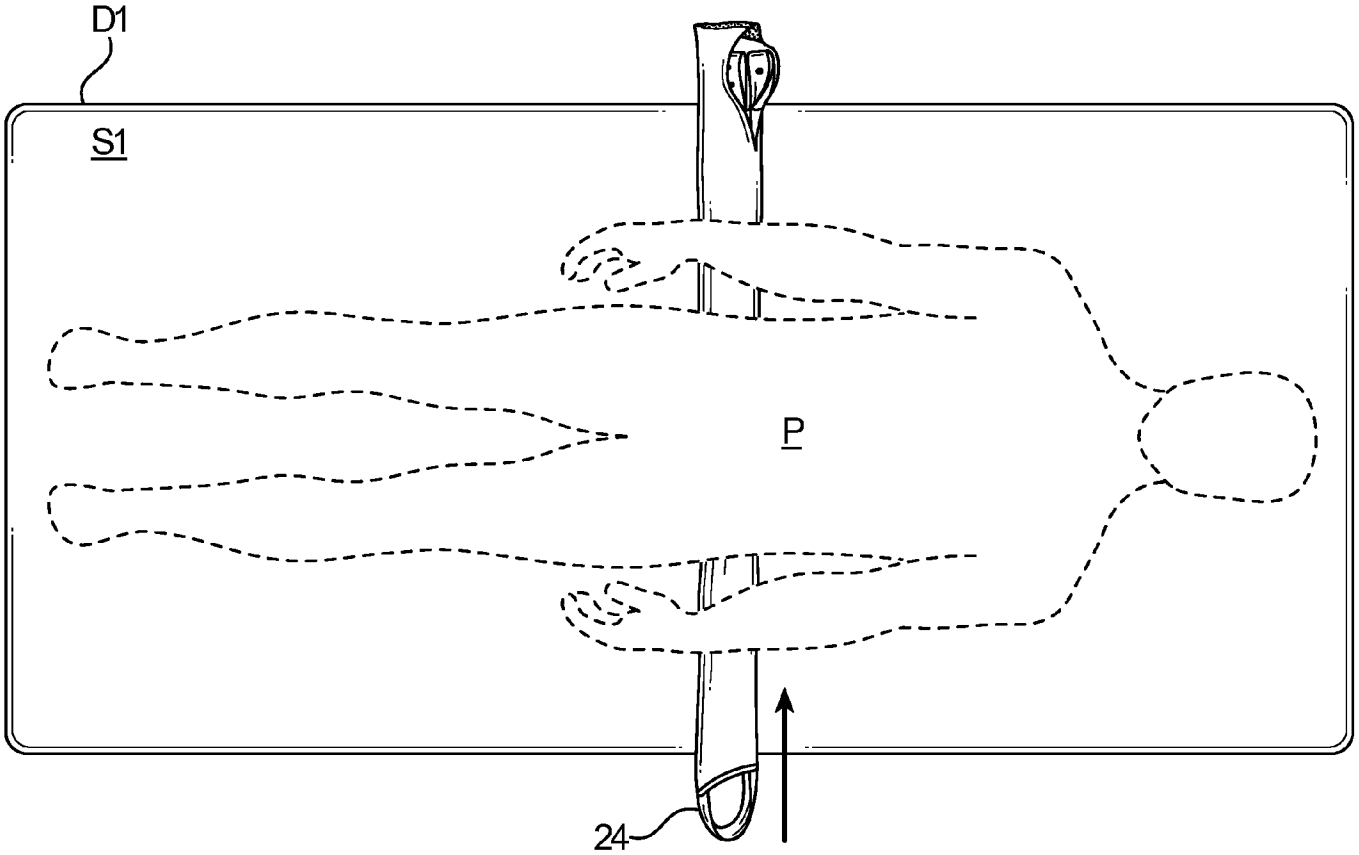
FIGS. 5A-5E illustrate an exemplary method for inserting and expanding the corrugated sheet of FIGS. 4A-4L under a patient.

As shown in FIG. 5A, the patient transfer assembly 10 including the corrugated sheet 12 and the bag 20 are first inserted into a channel formed between the patient P and the first resting surface S1. The channel between the patient P and the first resting surface S1 ideally corresponds to the lumbar region, lower torso, or lower back region of the patient P. This region of the body tends to arch up into the body forming a channel between the patient P and the first resting surface S1. The stiffeners 19 described above resist corrugation of the sheet on the sheet's lateral dimension; that is, the stiffeners 19 maintain the patient transfer assembly 10 stiff through the insertion into the channel formed between the patient P and the first resting surface S1.

In some cases, the channel formed between the patient P and the surface S1 may need to be expanded or even created to fit the patient transfer assembly 10. In those cases, the stiffness of the patient transfer assembly 10 due to the stiffeners 19 may help displace the surface S1 (e.g., a mattress) to aid in the insertion of the patient transfer assembly 10. Since the stiffeners 19 make the patient transfer assembly 10 including the bag 20 stiff and the bag 20 is constructed of a material that has a relatively low coefficient of drag or friction (i.e., the material is slippery), insertion of the patient transfer assembly 10 under the patient through the channel formed by the patient's lumbar region, lower torso, or lower back region should be relatively easy and should cause the patient very little, if any, discomfort.

Figure 5B:
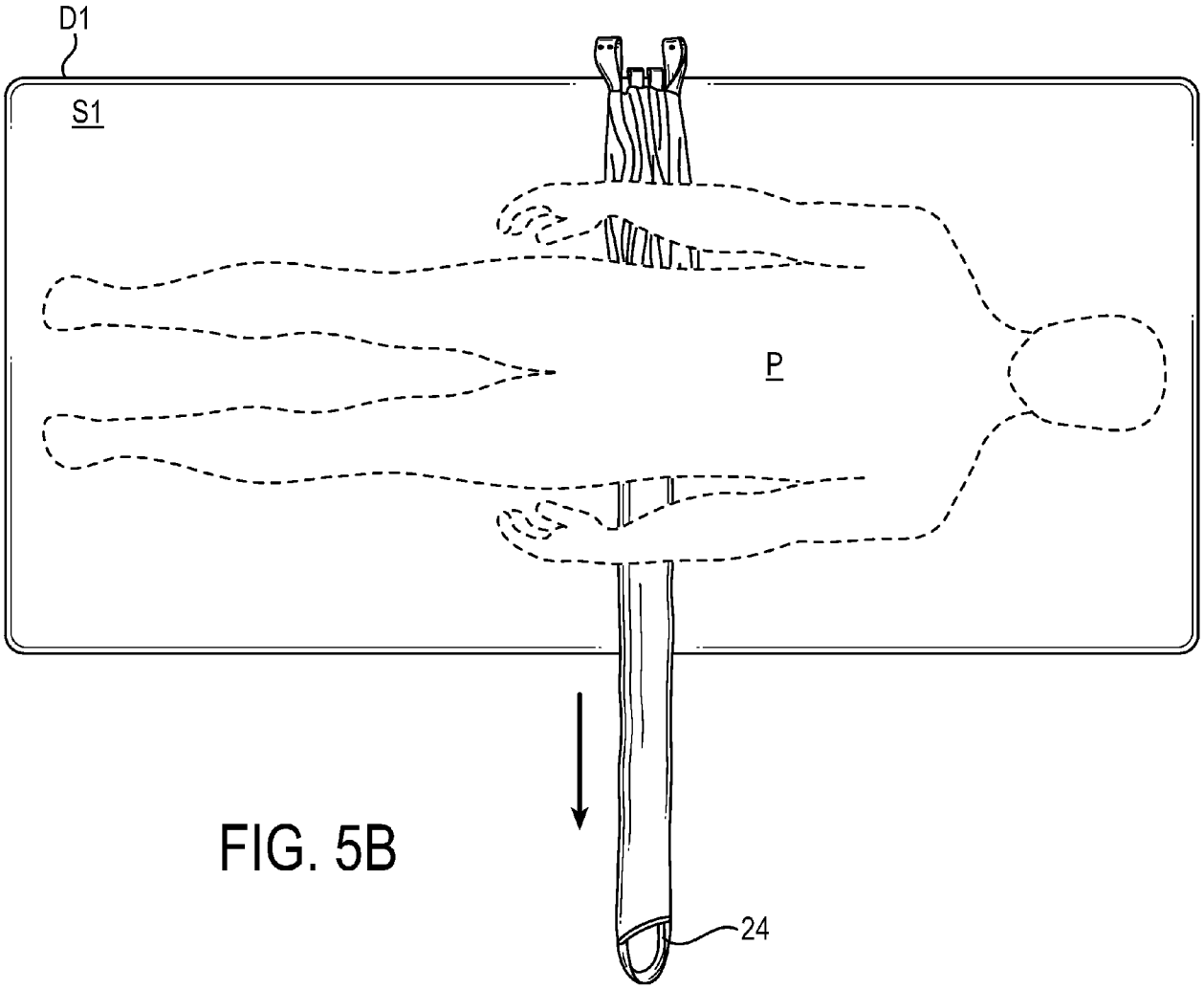
Figure 5C:
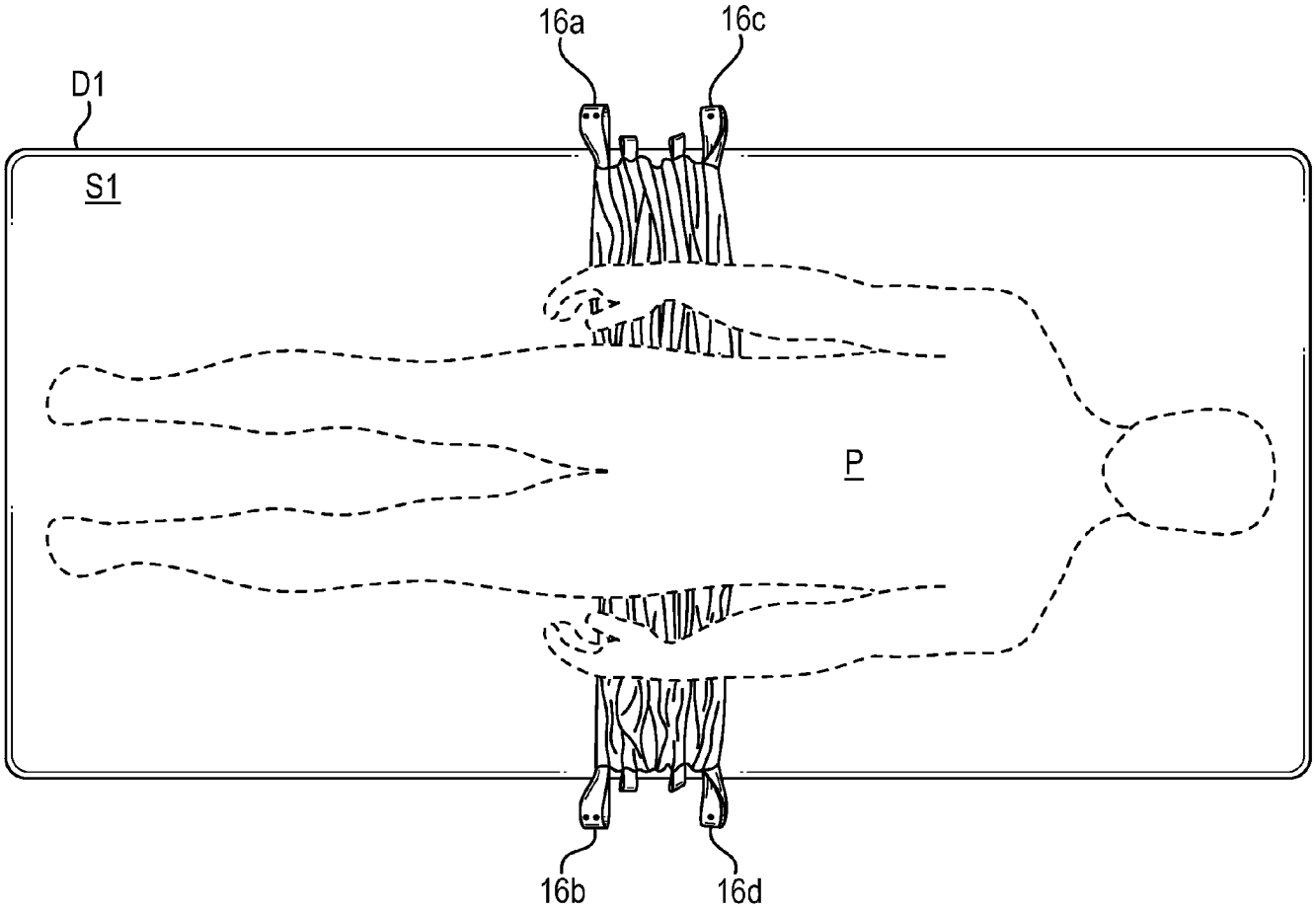

As shown in FIG. 5B, once the patient transfer assembly 10 including the bag 20 has been inserted between the patient P and the first surface S1, the bag 20 may be removed from between the patient P and the first surface S1 while the sheet 12 exits the bag through the opening 22 so that the sheet 12 remains between the patient P and the first surface S1. The handle 24 may be used to pull the bag 20 to remove the bag 20 from the channel while retaining the corrugated sheet 12 in place as shown in FIG. 5C.

In the embodiment of FIGS. 5A-5B, the patient transfer assembly 10 is shown as including the bag 20. However, as disclosed above, in other embodiments, the patient transfer assembly 10 may not include the bag 20. In such embodiments, it is the corrugated sheet 12 alone, as shown in FIG. 5C, that is inserted in the channel formed between the patient P and the first resting surface S1.

Figure 5D:
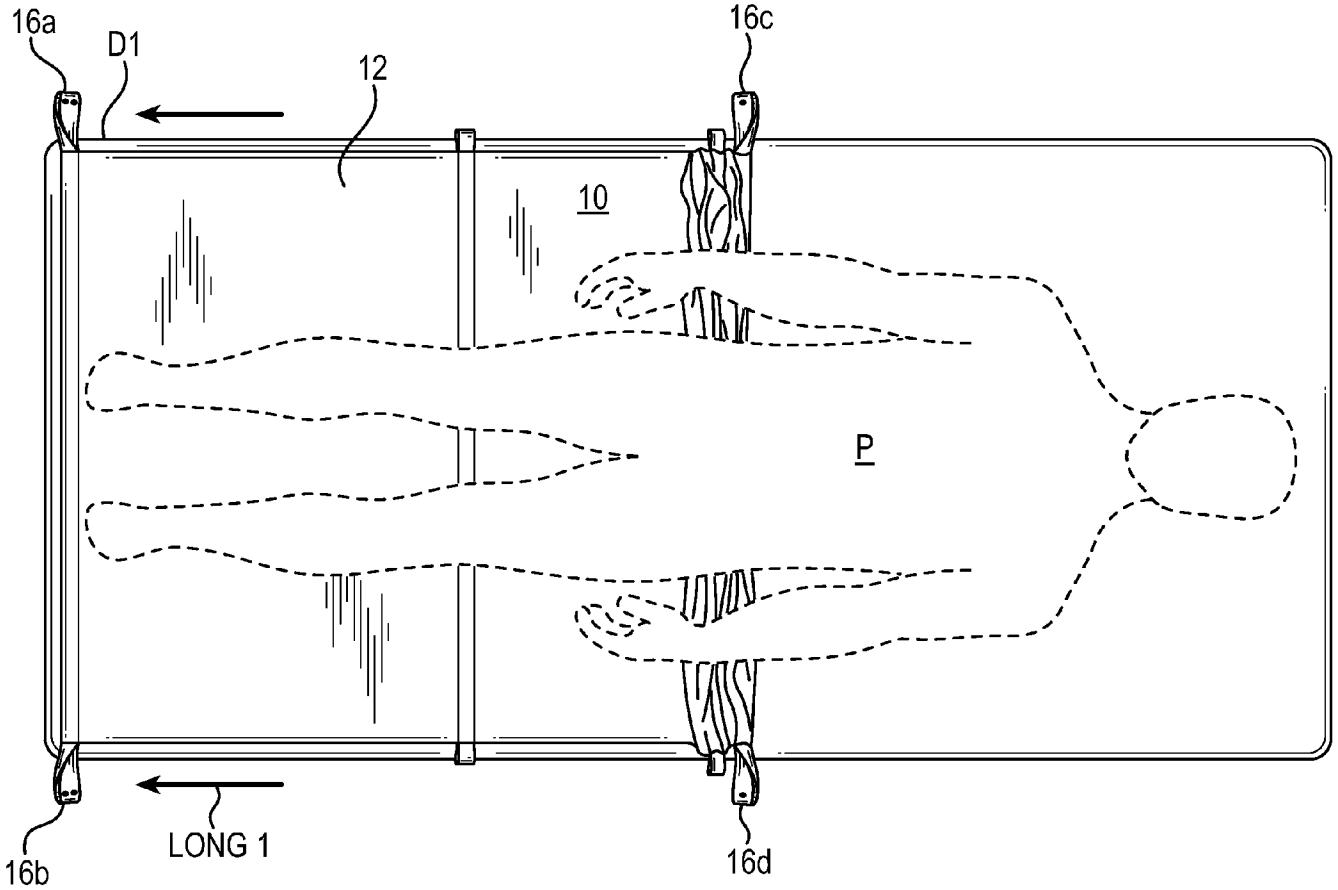
Figure 5E:
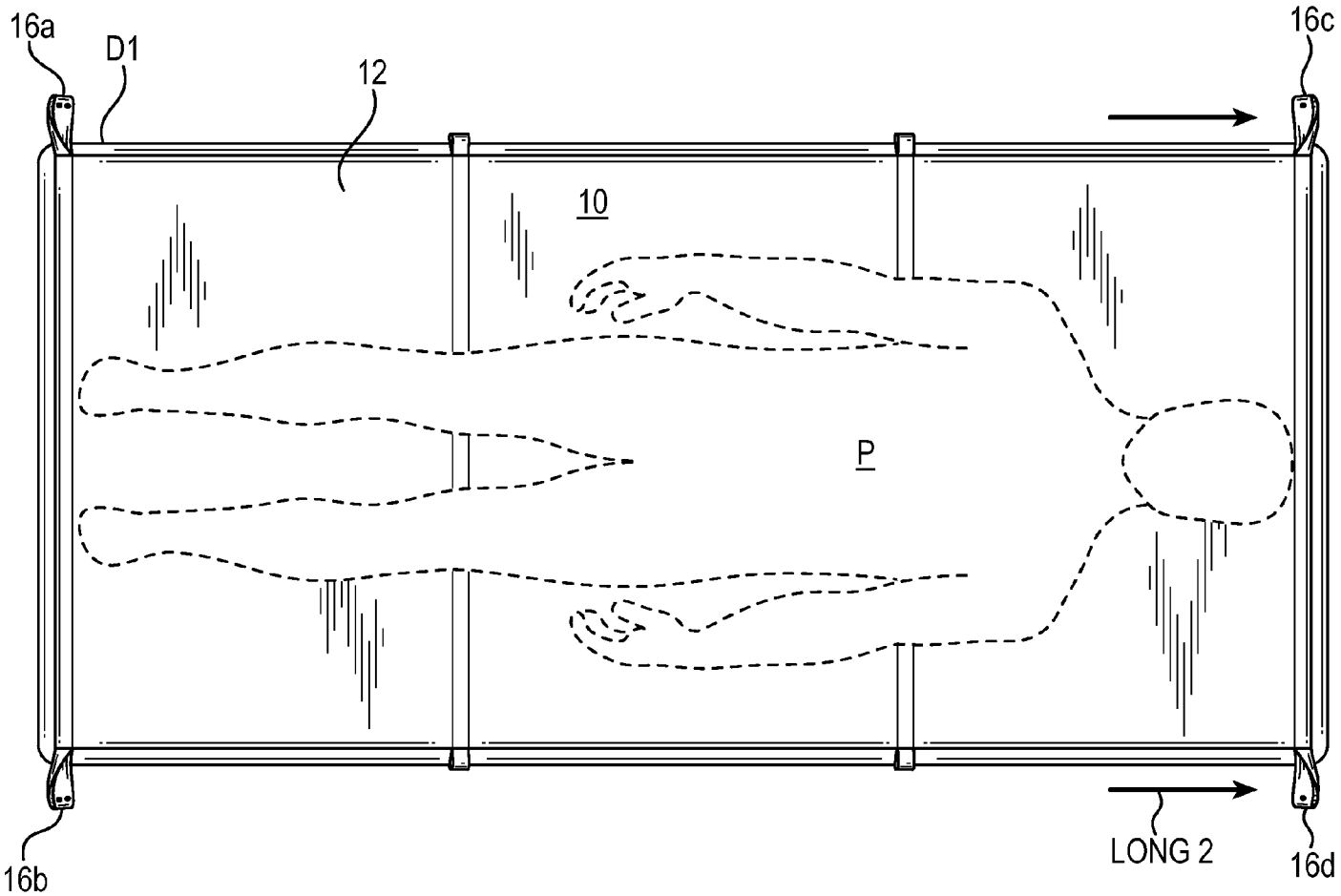

As shown in FIG. 5D, the sheet 12 is decorrugated under the patient P by extending a portion of the sheet 12 between the patient P and the first resting surface S1 to under the patient's feet. For example, the handles 16*a* and 16*b* may be used to pull on the sheet 12 along a longitudinal direction LONG 1. Similarly, as shown in FIG. 5E, the sheet 12 is decorrugated under the patient P by extending a portion of the sheet 12 between the patient P and the first resting surface S1 to under the patient's head. For example, the handles 16*c* and 16*d* may be used to pull on the sheet 12 along a longitudinal direction LONG 2. Since the sheet 12 is constructed of a material that has a relatively low coefficient of drag or friction (i.e., the material is slippery), decorrugation of the sheet 12 under the patient P should be relatively easy and should cause the patient very little, if any, discomfort.

In the illustrated embodiments and as shown in more detail in FIGS. 2 and 3, handles intended to be pulled towards one direction are marked differently from handles intended to be pulled in the opposite direction. For example, handles intended to be pulled towards one direction (e.g., the patient's head) may be marked with a single dot and handles intended to be pulled in the opposite direction (e.g., towards the patient's feet) may be marked with two dots. Marking as described should reduce the chance that the handles are criss-crossed by mistake.

As shown in the progression of FIGS. 6A-6D, after the sheet 12 has been decorrugated or extended under the patient P, the patient may be transferred from the surface S1 of the first resting device D1 to the surface S2 of the second resting device D2 by pulling laterally on the patient transfer assembly 10 to slide the sheet 12 from the first resting surface S1 to the second resting surface S2.

Pulling laterally of the patient transfer assembly 10 to transfer the patient P may be done by a machine or patient transfer device 30 as illustrated or by health care workers or other people depending mostly on availability of the device 30 and the weight of the patient P. Where a patient transfer device 30 is used, the device 30 may engage the patient transfer assembly 10 at the fasteners 18. Where health care workers or other people perform the transfer, they may pull the patient transfer assembly 10 from the general area of the fasteners 18 or the handles 16. Pulling laterally at these positions on the patient transfer assembly 10 in a direction substantially parallel to the first surface S1 should distribute the pulling force to portions of the sheet 12 on which a majority of the weight of the patient P rests allowing for transfer of the patient P on the sheet 12. Since the sheet 12 is constructed of a material that has a relatively low coefficient of drag or friction (i.e., the material is slippery), transfer of the patient P should be relatively easy and should cause the patient very little, if any, discomfort.

The patient transfer assembly 10 may remain in place under the patient P or it may be removed from under the patient P by pulling up on the sheet 12 or the handles 16 with a force or speed that creates moment and thus significantly reduces friction between the sheet 12 and the patient P. The sheet 12 may be pulled in a direction that is non-parallel with the surface S2 such that the sheet 12 slips from under the patient P without carrying the patient P.

FIGS. 7A-7M illustrate various views of an exemplary patient transfer device 30. As shown in FIGS. 6A-6D, the patient transfer device 30 can be used to transfer a patient P from a first resting device D1 to a second resting device D2.

In reference to FIGS. 7A-7I, the device 30 includes a bottom assembly 32 disposed at a bottom portion of the patient transfer device 30. The bottom assembly 32 includes wheels or casters 34 for transporting or wheeling the patient transfer device 30 throughout, for example, a medical facility. In the illustrated embodiment, the device 30 includes friction locking elements 36 that extend from the bottom of the bottom assembly 32. The friction locking elements 36 include respective high friction surfaces that, when in contact with a floor, lock the device 30 to the floor by means of friction. The device 30 also includes a locking pedal 38 operatively connected to the friction locking elements 36 such that operation of the locking pedal 38 causes the friction locking elements 36 to contact the floor upon which the patient transfer device 30 rests thereby effectively locking the patient transfer device 30 to the floor. In other embodiments, in the device 30, instead of or in addition to the friction locking elements 36 and the locking pedal 38, the wheels or casters 34 may be lockable to lock the device 30 in place.

The device 30 also includes a motor 40 disposed at or adjacent the bottom assembly 32. The motor 40, a relatively heavy component of the device 30, being located at the bottom portion of the patient transfer device 30 tends to give the device 30 a low center of gravity and, thus, some measure of stability, particularly as compared to some prior art devices that may be top heavy and thus not nearly as stable. The motor 40 may be an electric reversible motor. The motor 40 may be supplied 115 volt A/C power input via a power cord 48 which can be connected to a conventional electrical outlet. In the illustrated embodiment, the power cord 48 is retractable. The 115 volt A/C input maybe converted or otherwise controlled by circuitry (not shown) in an electrical box 50, which may include solenoids, relays, switches, etc. The motor 40 may have an output shaft (not shown) that is connected to a power transfer mechanism that may include gearing (not shown) and a clutch 42. The clutch 42 is connected to a toothed drive gear 44, which is in turn connected to another toothed drive gear 45 by a belt or chain 46.

The power transfer mechanism further includes a power transfer rod 52 connected to reels 54. The reels 54 have wound therein webbing, straps or belts 56. Hereinafter we will refer to the belts 56 as belts. However, the belts 56 may correspond to webbing, an elastomeric belt, a leather belt, a steel reinforced belt, a chain, a rope or similar device.

Figure 8:
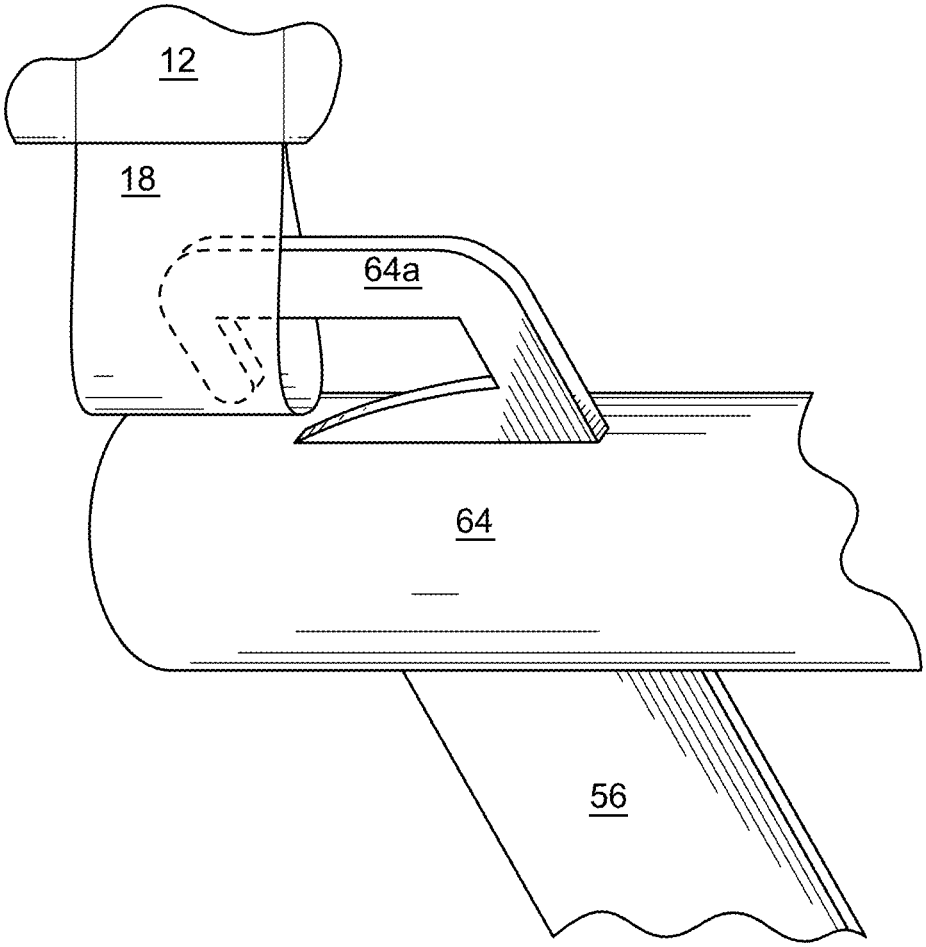
FIG. 8 illustrates exemplary engagement of a transfer sheet by the patient transfer device.

The device 30 also includes a top assembly 60 disposed at a top portion of the patient transfer device 30. The top assembly 60 includes pulleys 62 or similar force-transferring devices. The reels 54 each has at least some portion of the belts 56 wound therein and some portion of the belts 56 extends through the pulleys 62. The belts 56 ultimately connect to a sheet engaging mechanism that includes a power transfer bar 64. As best shown in FIG. 8, the power transfer bar 64 connects to the belts 56 and may include hooks 64*a* or some other fastener to connect to the sheet 12 or a fastener 10 of the sheet 12.

A problem in the prior art was that, in some patient transfer devices, the sheet was pulled at discrete locations that tended to move towards each other when pulled. the sheet clustered at a central location and slid off from under the patient providing ineffective patient transfer. The power transfer bar 64 including the fasteners 64*a* that engage the sheet 12 proximate the power transfer bar 64 prevents the pulling locations of the sheet from moving towards each other when pulled. In one embodiment, the power transfer bar 64 is at least as long as the distance between two of the pulleys 62. In another embodiment, the power transfer bar 64 is at least as long as half the length of a resting device from which the patient is being transferred. In one embodiment, the power transfer bar 64 is between 24 and 48 inches inclusive. In another embodiment, the power transfer bar 64 is shorter than 24 inches or longer than 48 inches.

Figure 7A:
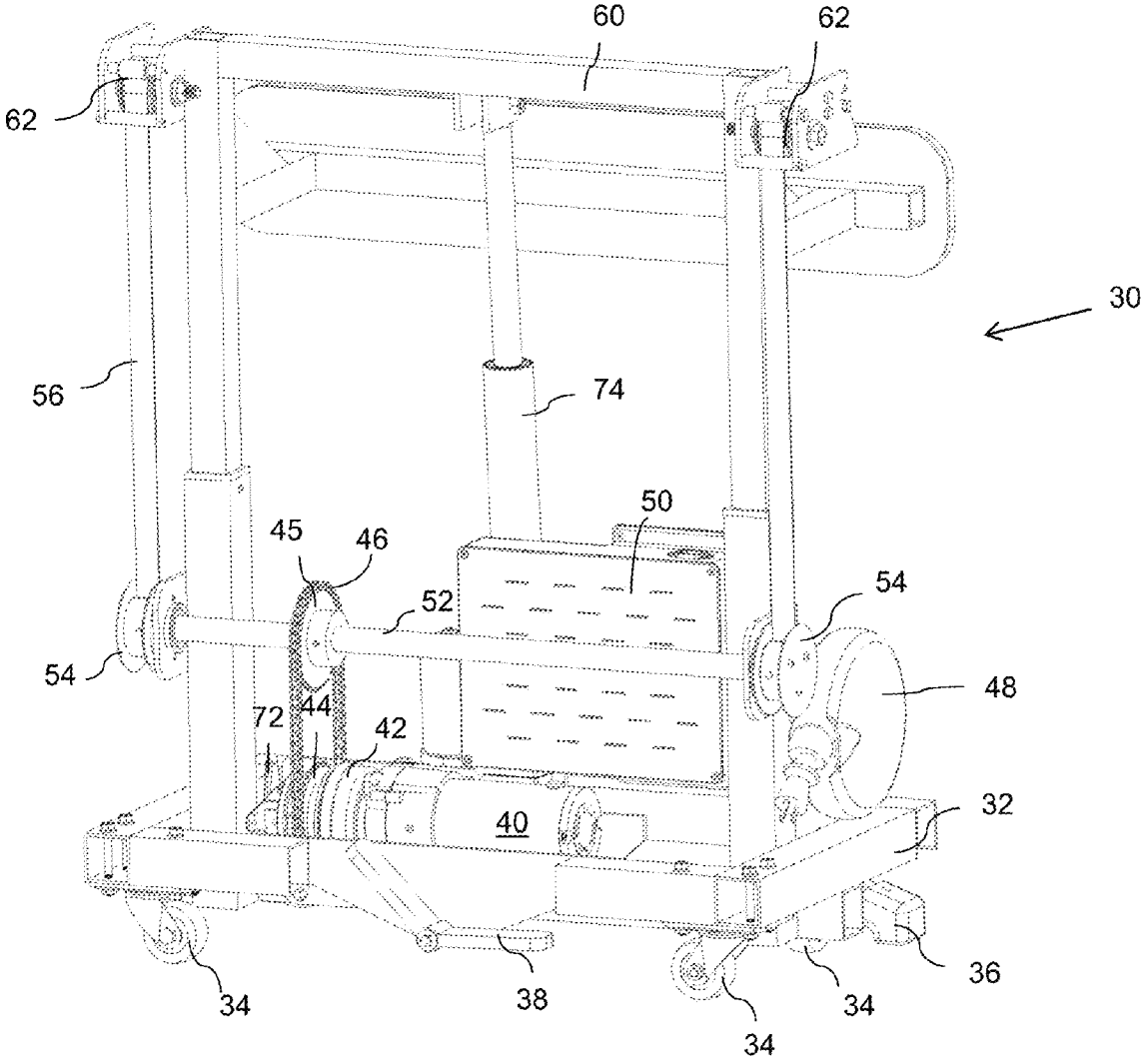
FIGS. 7A-7M illustrate various views of an exemplary patient transfer device.
Figure 7B:
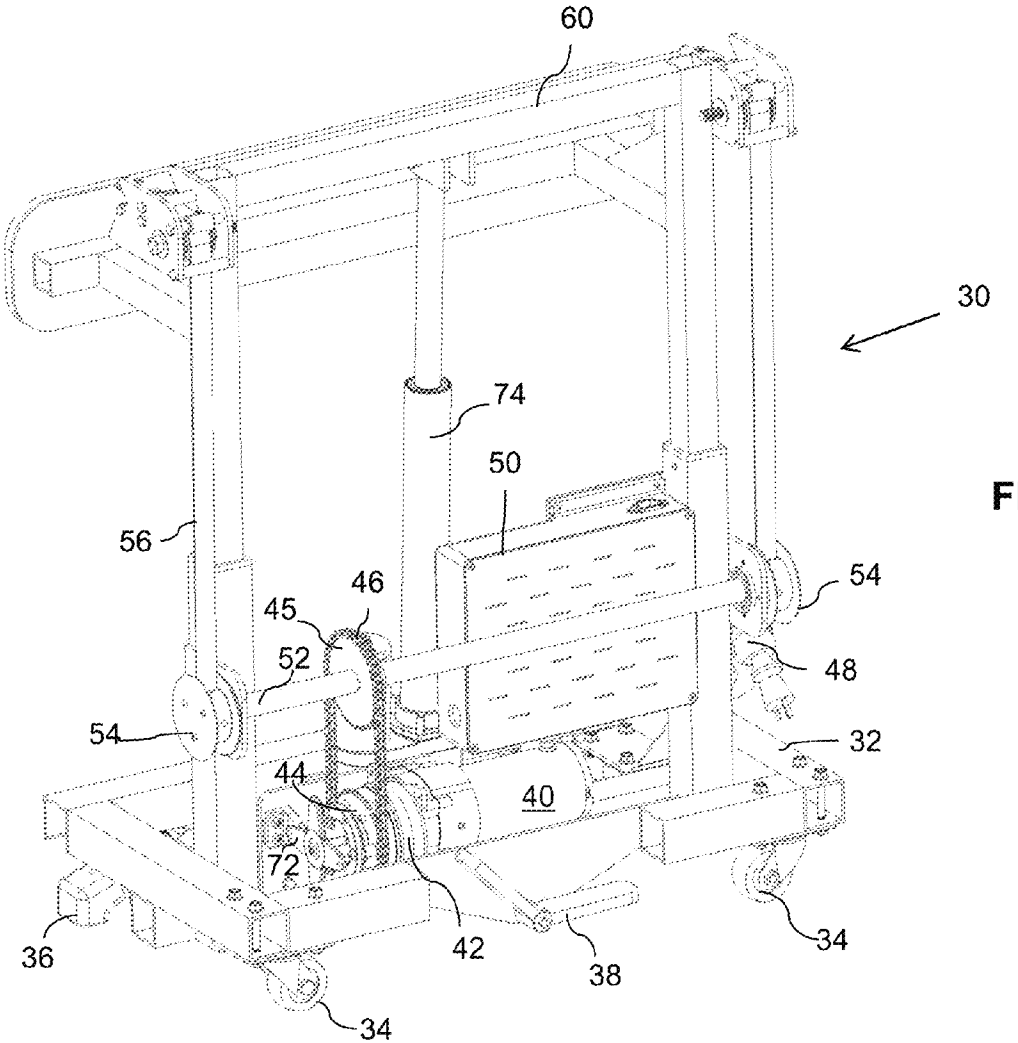
Figure 7C:
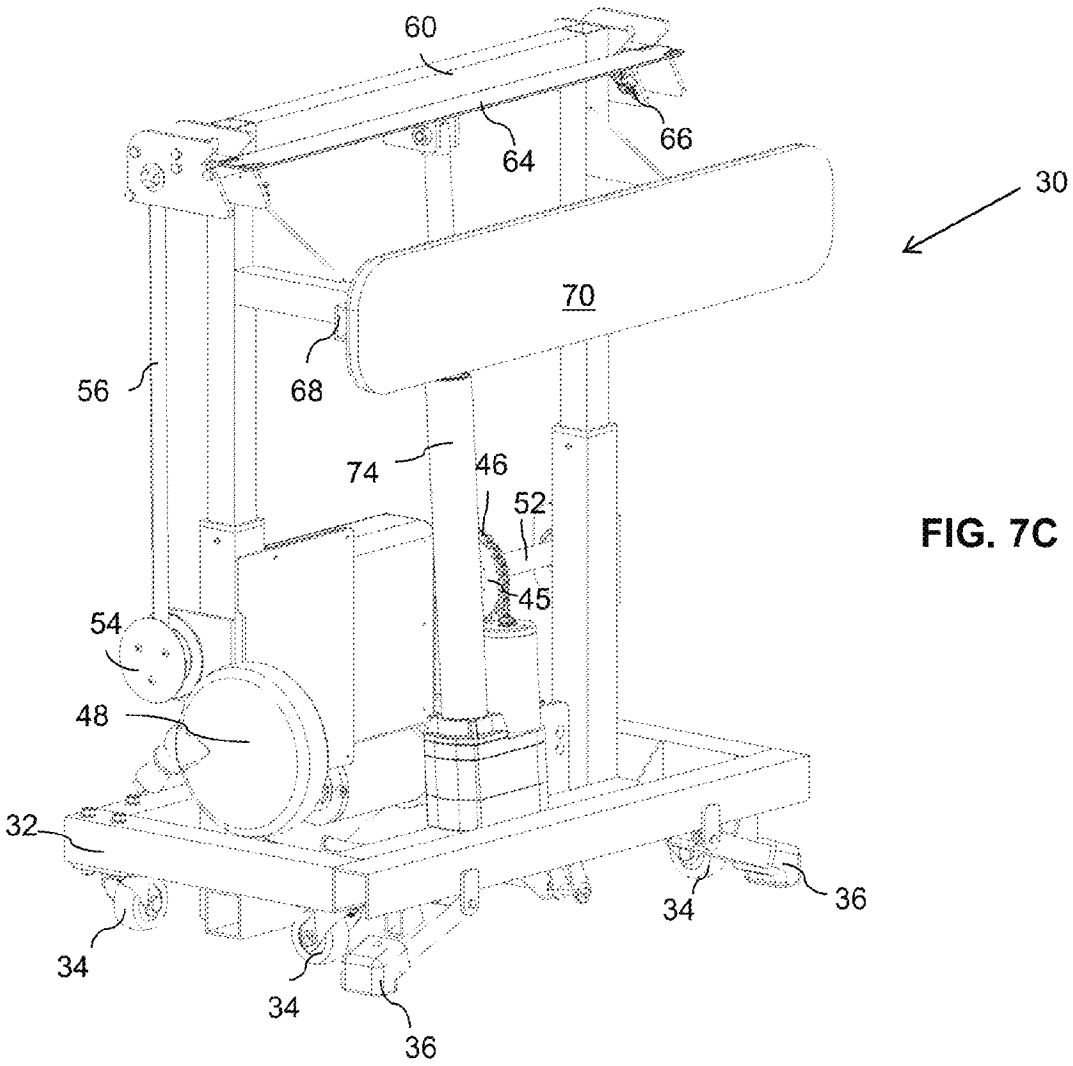
Figure 7D:
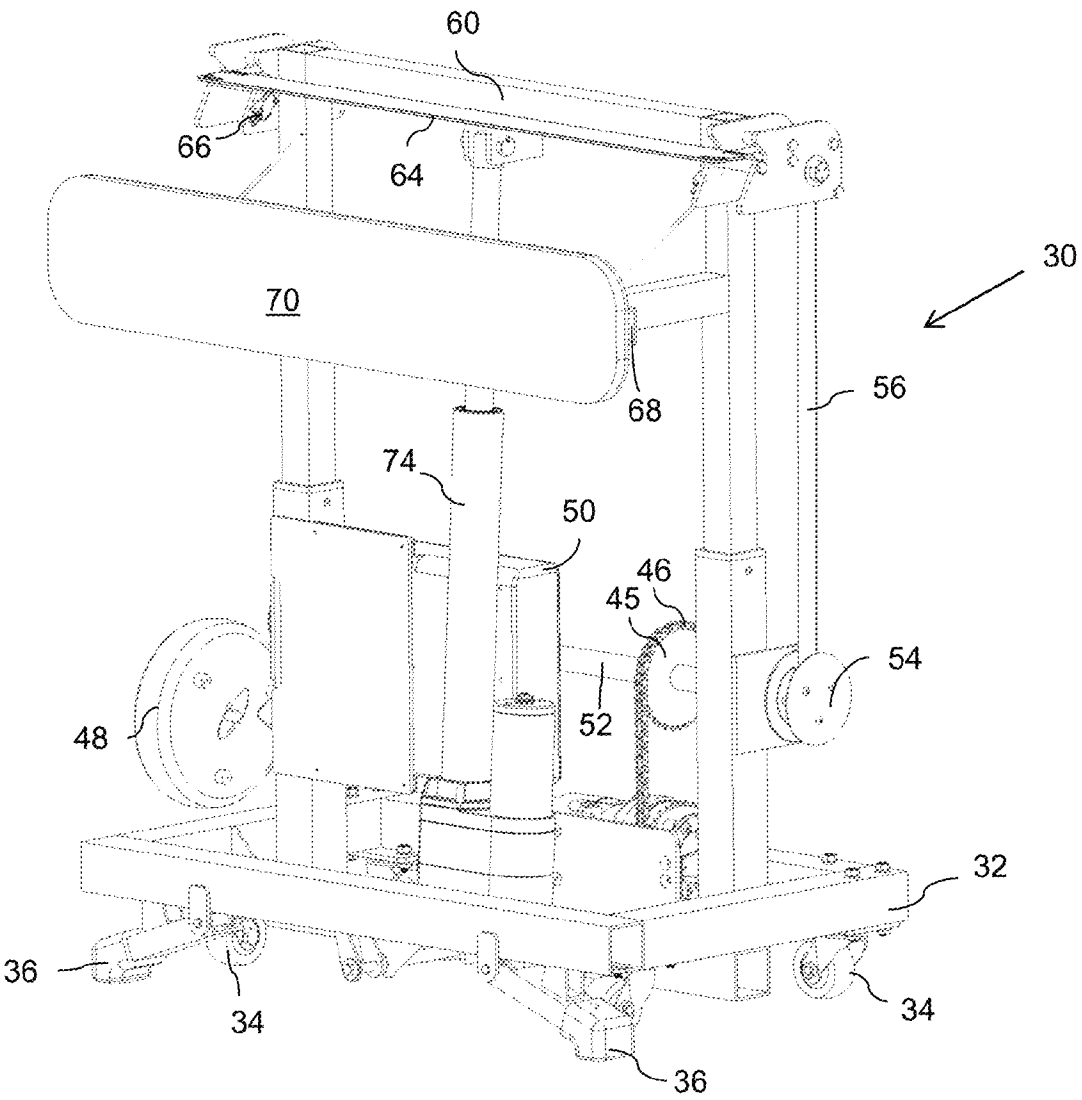
Figure 7E:
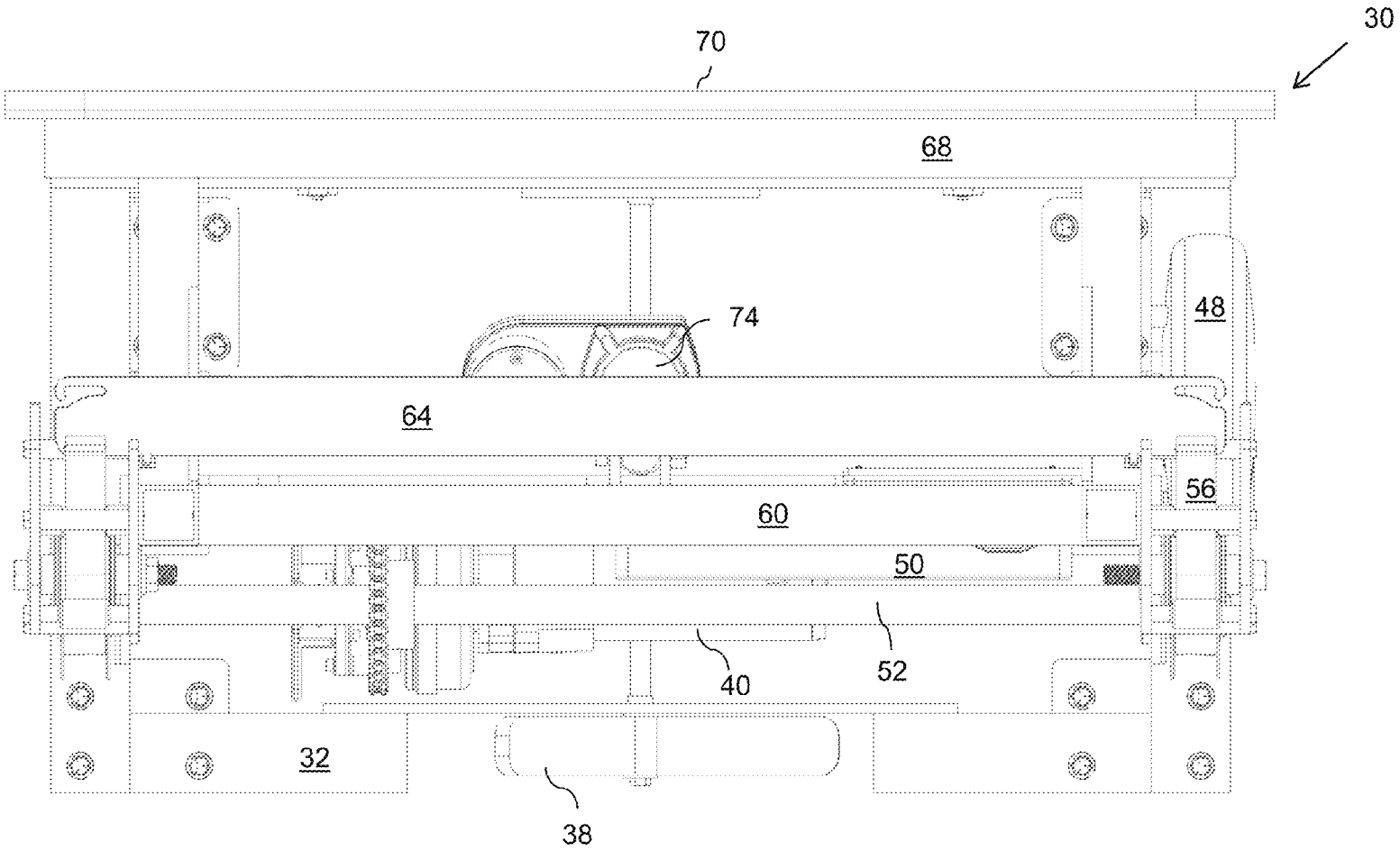
Figure 7F:
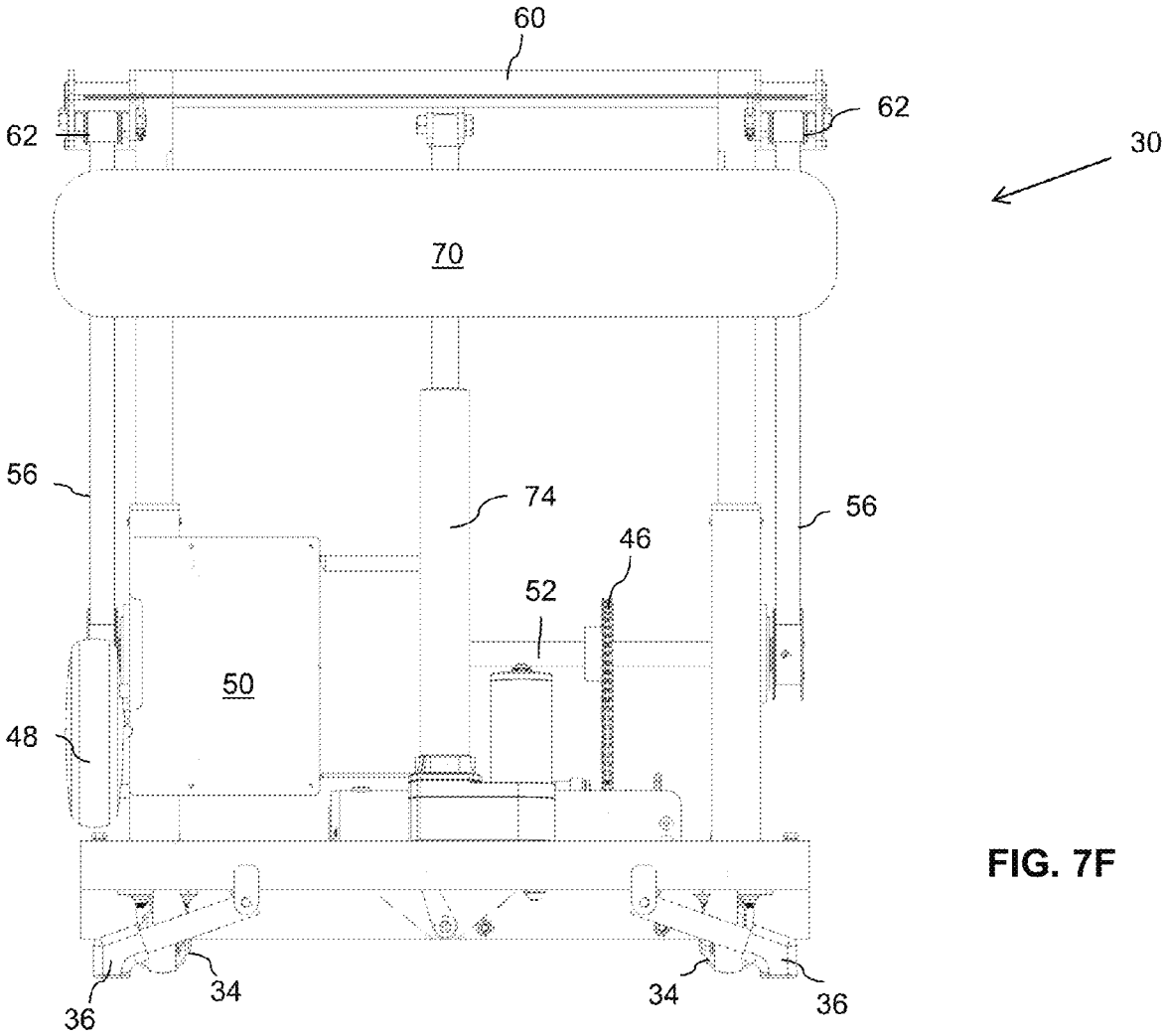
Figure 7G:
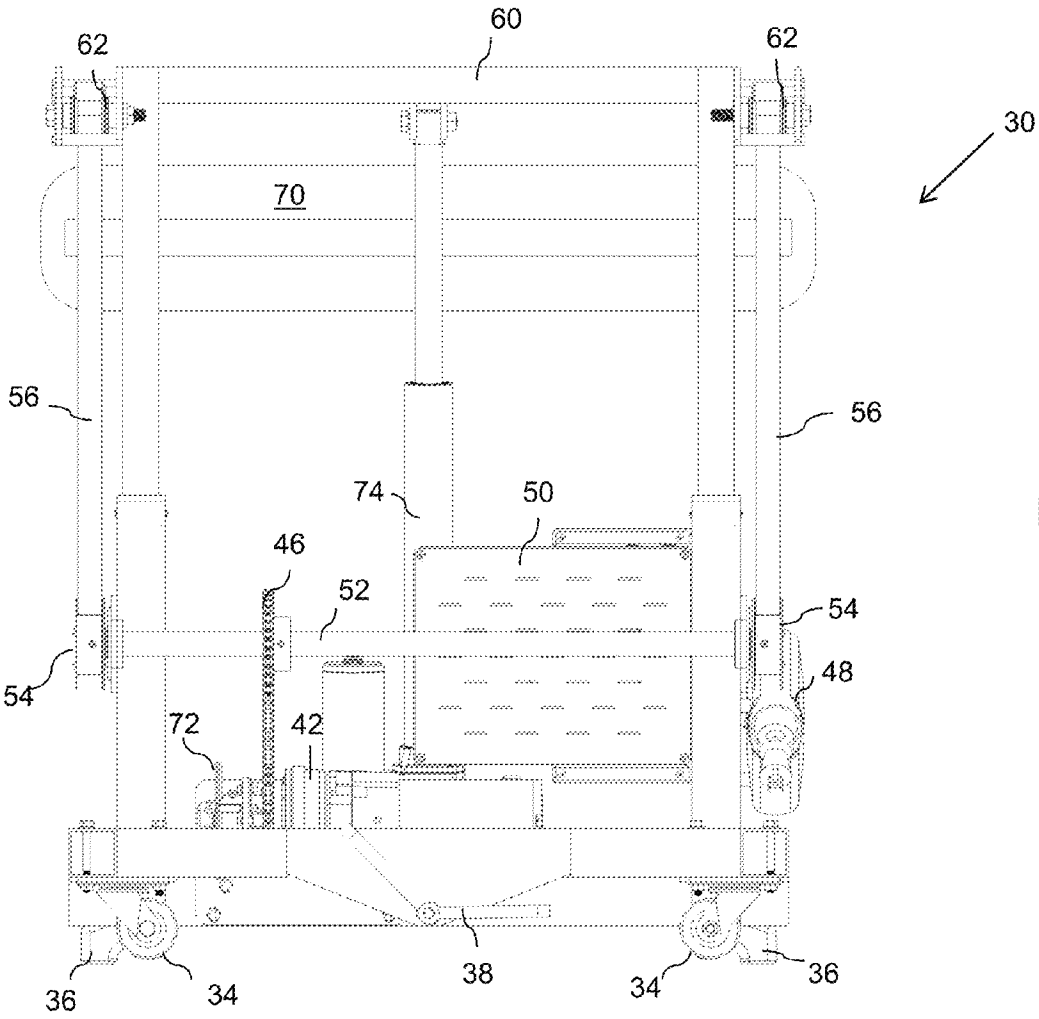
Figure 7H:
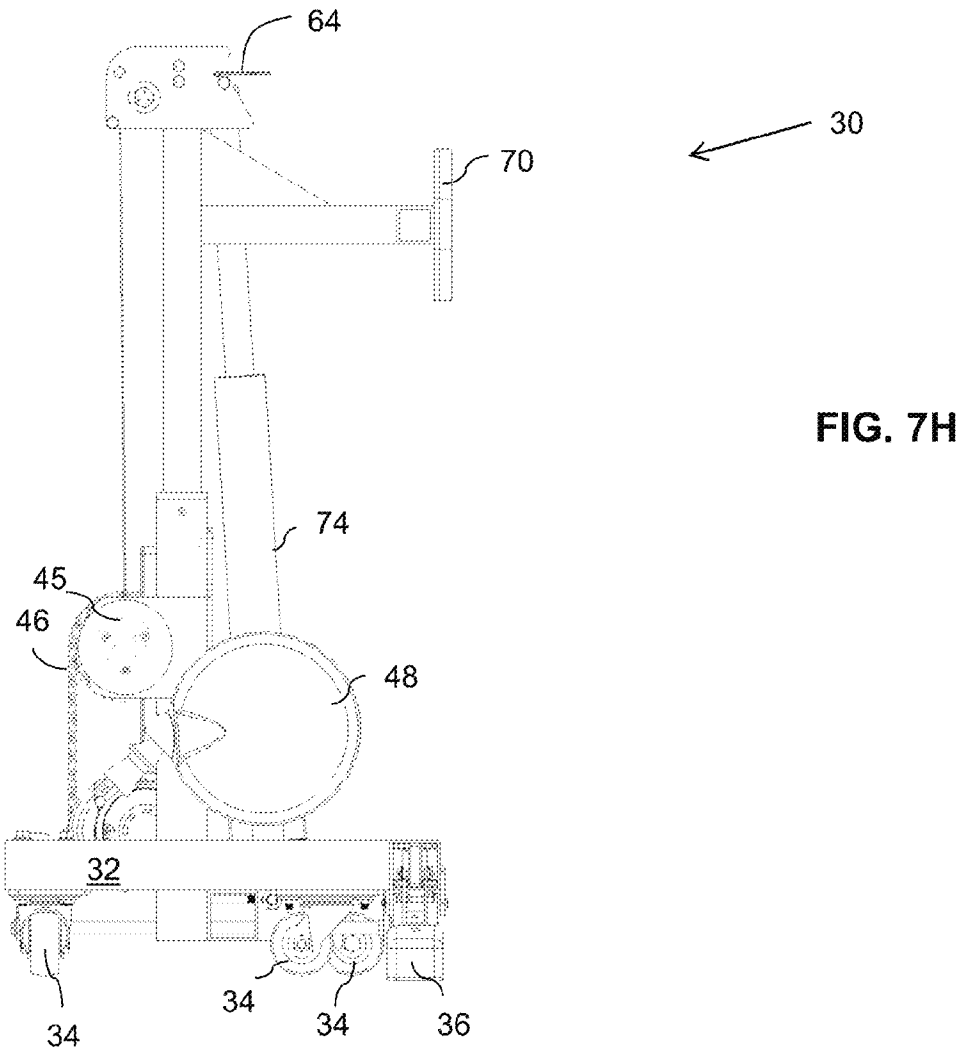
Figure 7I:
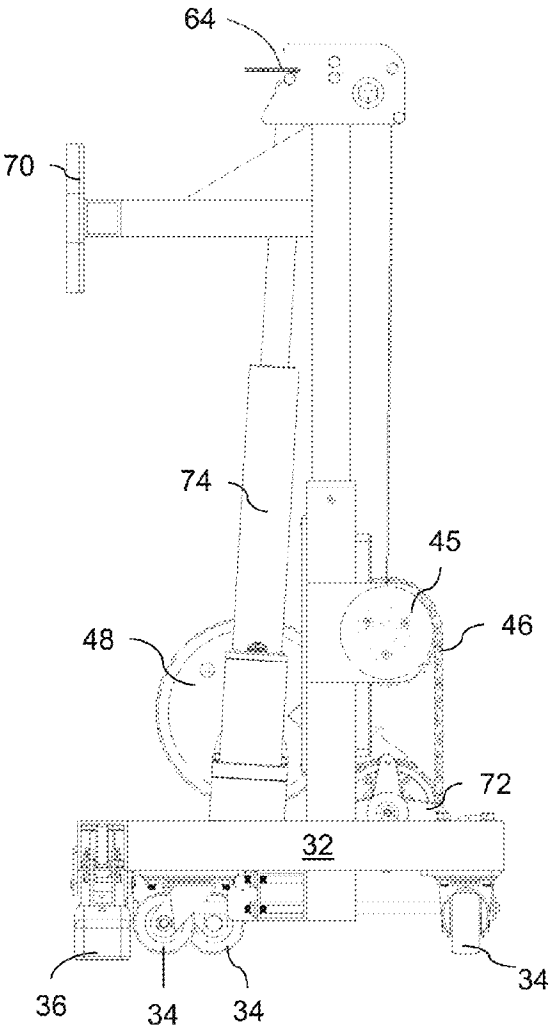
Figure 7J:
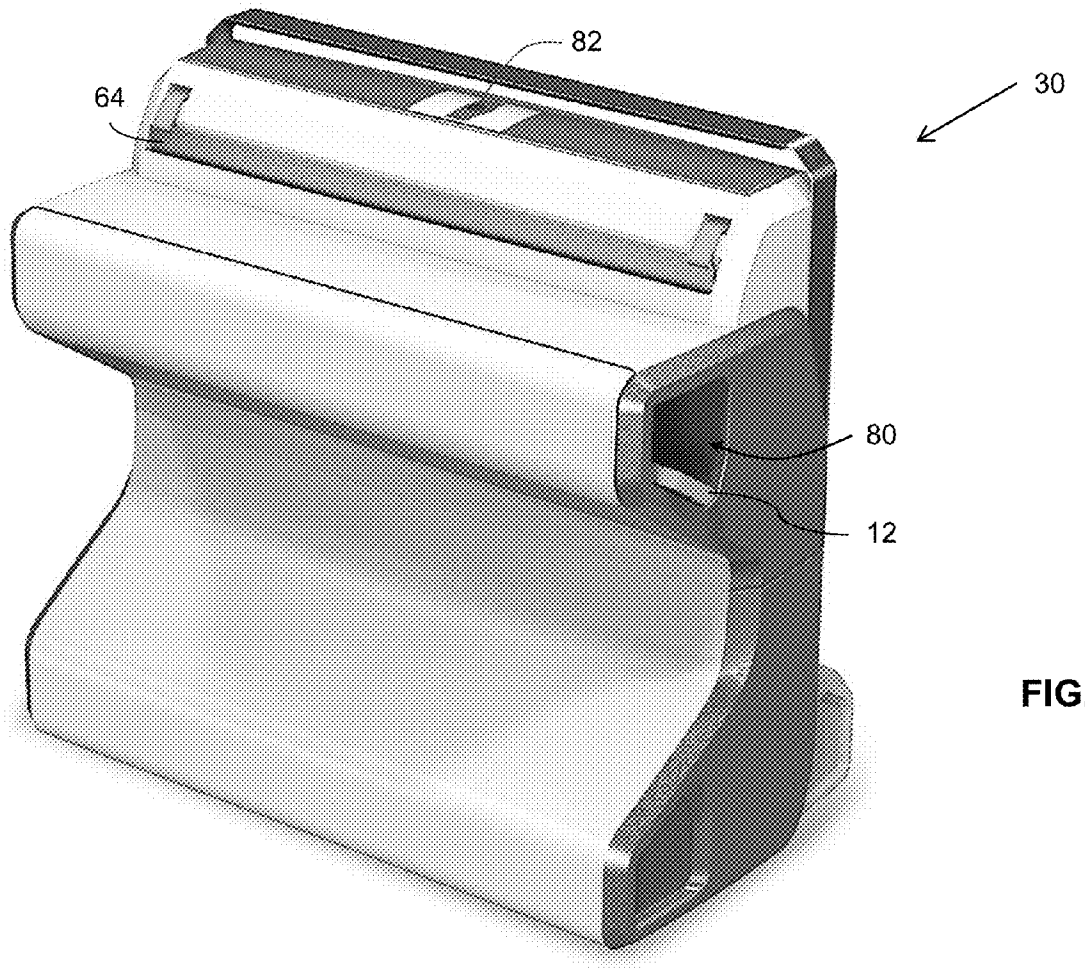
Figure 7K:
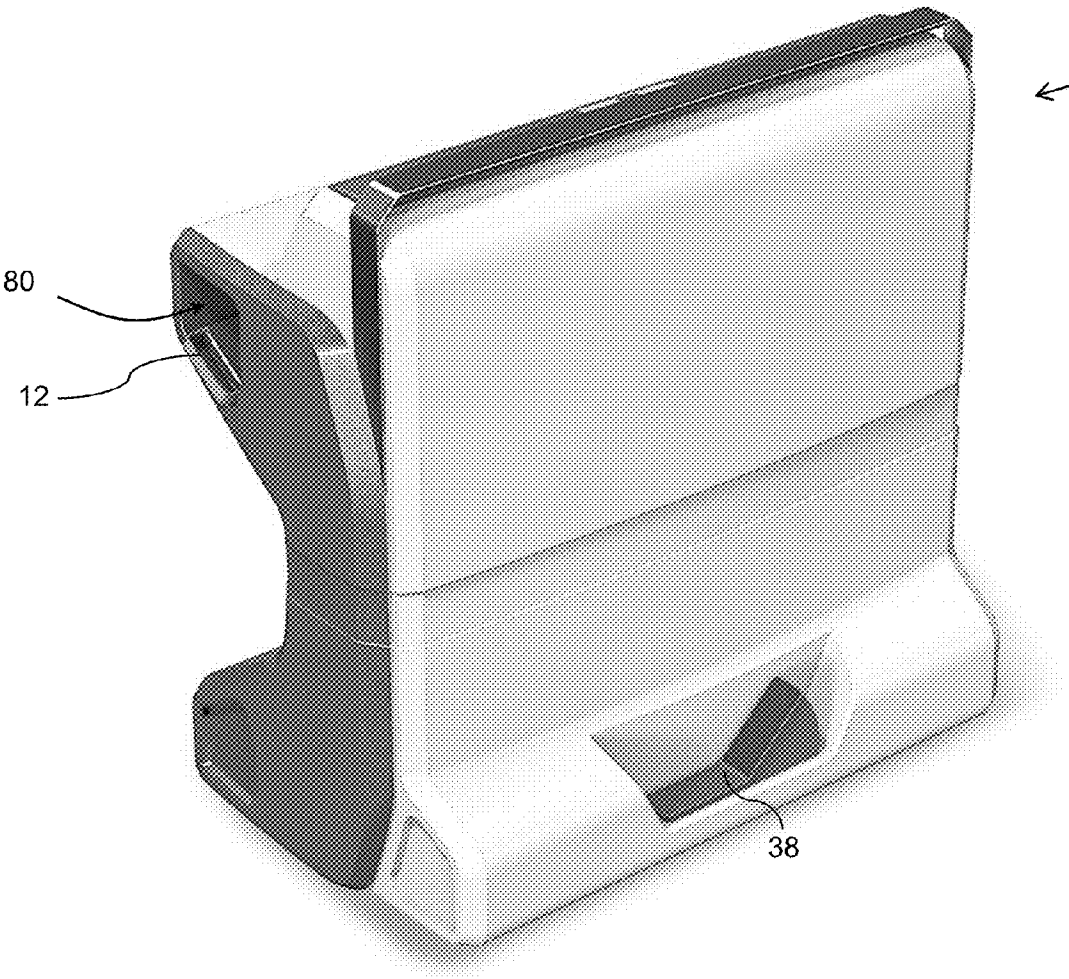

As described in more detail below, the device 30 also includes a bumper assembly 68 that includes a bumper surface 70 for contacting the second resting device, the device to which the patient is to be transferred. As illustrated in FIGS. 7H and 7I, the bumper assembly 68 is disposed on a side of the patient transfer device 30 such that the bumper surface 70 extends from the device 30 at least as far as or farther than a footprint of the bottom assembly 32. Some prior art devices had bases that were generally too big and protruded forward too far. Therefore, the devices could not be wheeled close enough to the second resting device to which the patient is being transferred to be effective. The construction of the device 30 including the respective dimensions and locations of the bottom assembly 32 and the bumper surface 70 addresses these issues. The bumper also distributes the force between the device 30 and the second resting device to which the patient is being transferred to a relatively large area, thus protecting the device 30 and the second resting device. Prior devices, to the extent that they provided any protection for the second resting device, provided protection that was limited in that they did not distribute the force across a large enough surface (force was concentrated on small areas) often resulting in damage to the second resting device.

The power transfer mechanism may also include a spring return mechanism 72 coupled to at least one of the motor 40 and the reels 54. A potential problem with devices such as the device 30 may be that slack on the belts 56 causes the motor 40 or power transfer mechanism, when activated, to "jerk" the patient when picking up slack on the belts 56. This may be uncomfortable to the patient. In the device 30, even prior to activation of the motor 40, the spring return mechanism 72 acts to tighten the belts 56, thus addressing the potential problem. Tightening of the belts 56 (taking up the slack) prior to activation of the motor 40 also eliminates the time spent waiting for the transfer to begin i.e., the time spent waiting for the motor 40 to pick up the slack of the belts 56.

The device 30 also includes an actuator 74 that is connected to the bottom assembly 32 and the top assembly 60 for adjusting the vertical position of the top assembly 60 and thus the pulleys 62 and the pulling force. Vertical adjustment of the pulling force applied to the sheet may be necessary to ensure that the force is substantially horizontal or maybe slightly upwardly inclined to the horizontal to maximize the pulling forces applied to the slide sheet and minimize the creation of turning moment forces. In one embodiment, the actuator 74 may be powered and/or controlled mechanically. In another embodiment, the actuator 74 may be connected to the circuitry in the electric box 50 for the actuator to be powered and/or controlled electronically.

The device 30 also includes an auto-stop mechanism that includes a sensor 66. The auto-stop mechanism shuts off the motor 40 when, as sensed by the sensor 66, the edge of the sheet 12 reaches a predetermined position past the bumper surface 70 corresponding to a full transfer of the patient P.

Figure 7L:
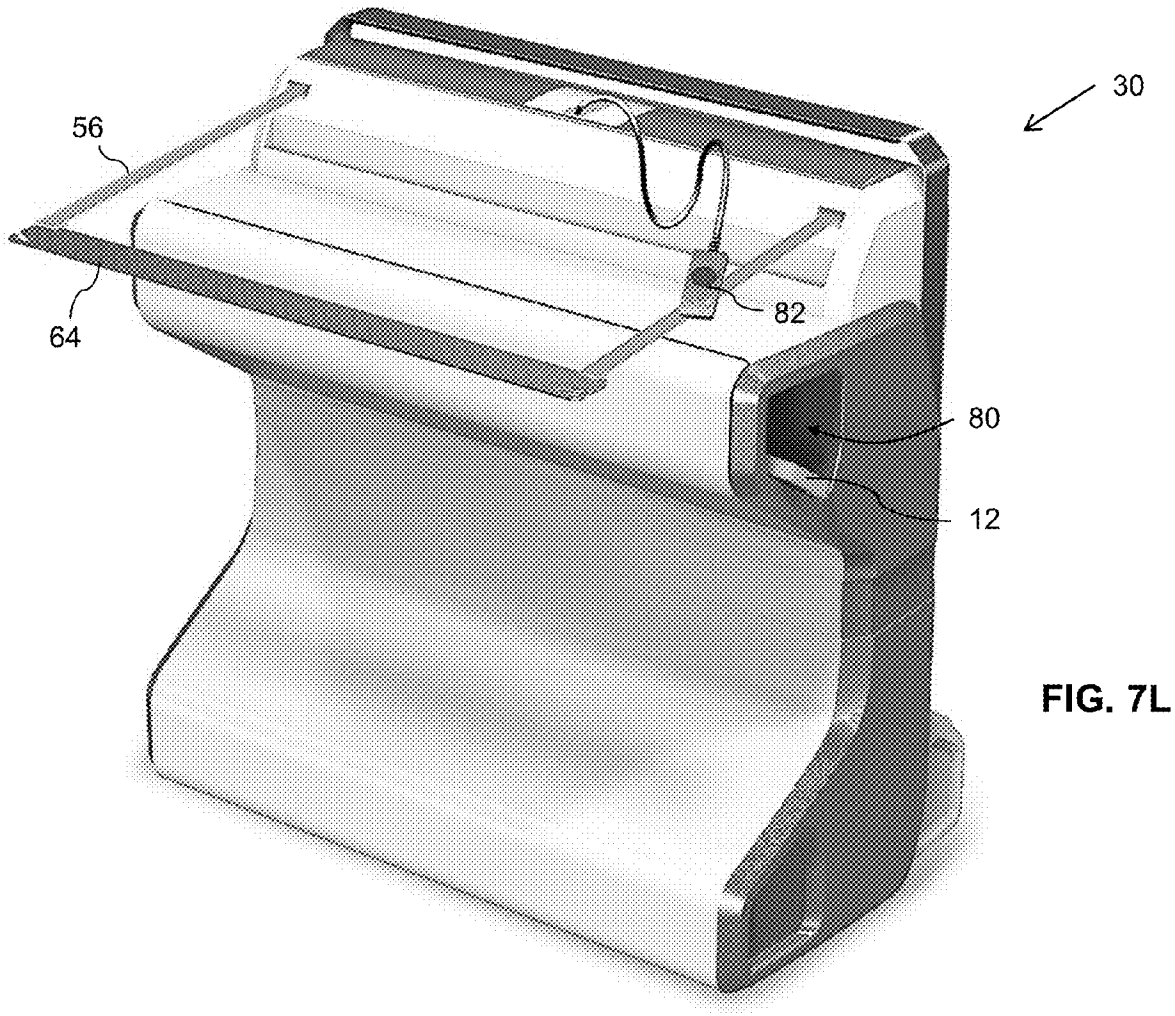
Figure 7M:
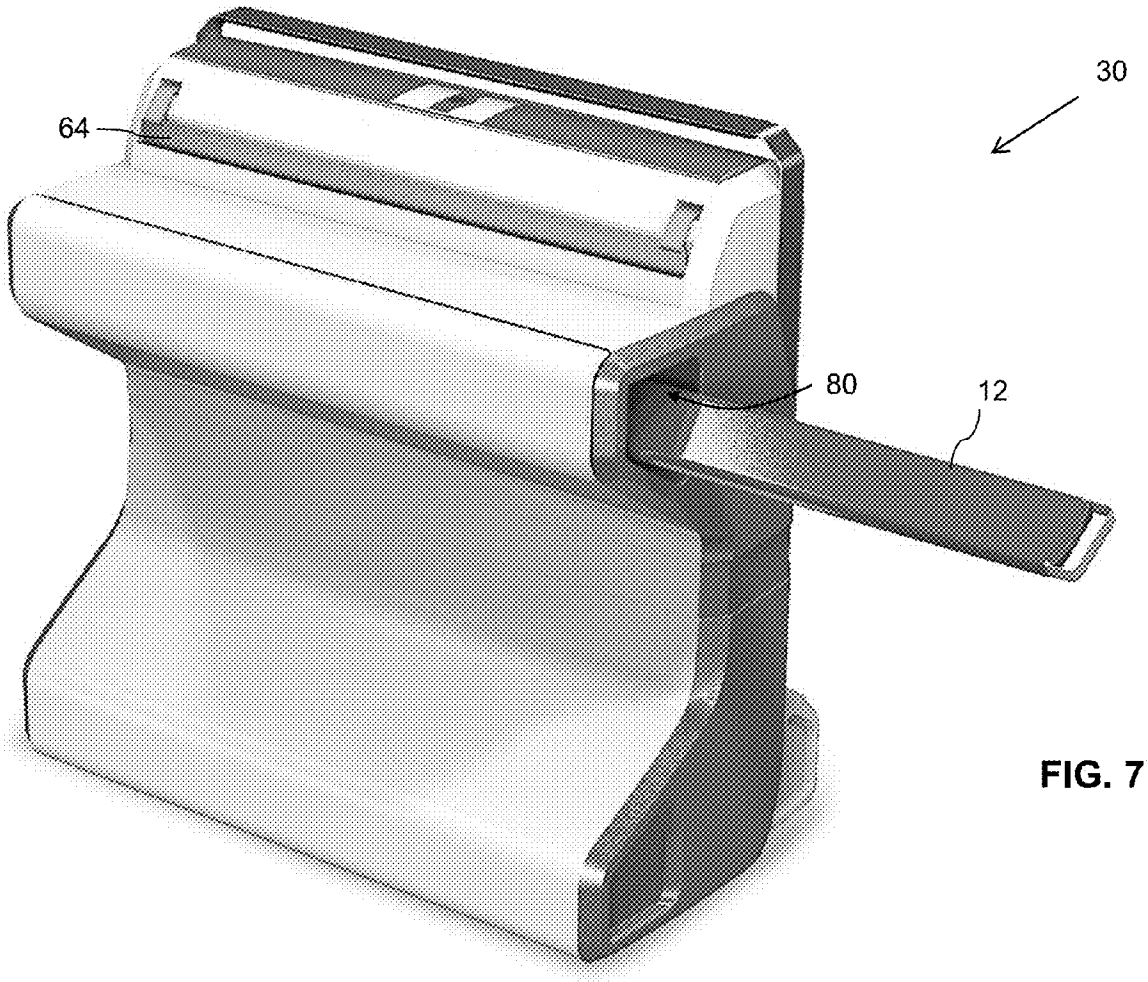

FIGS. 7J-7M illustrate perspective views of the exemplary patient transfer device 30 enclosed in a housing. The housing precludes access to most of the moving parts to prevent damage thereto and to prevent injury to patients and health workers. The device 30 may also include a control 82 as shown in FIG. 7L. The control 82 may include buttons or similar devices such that an operator may control operation of the device 30 including the motor 40, the actuator 74, etc. by operation of the control 82. The housing may also include a pocket 80 for storage of a patient transfer sheet 12.

Returning to FIGS. 6A-6D, the second resting device D2 is positioned adjacent the first resting device D1. The patient transfer device 30 is then wheeled from the position shown in FIG. 6A to the position shown in FIG. 6B after which the top assembly 60 can be vertically adjusted utilizing the actuator 74. The bumper surface 70 is positioned against the second resting device D2. At this point, the clutch 42 is not engaged and thus the operator may grasp the power transfer bar 64 and easily pull the same to the position shown in FIG. 6B to unwind the belts 56 such that the power transfer bar 64 may engage the sheet 12. Upon the power transfer bar 64 engaging the sheet 12 and the operator letting go of the power transfer bar 64, the spring return mechanism 72 acts to tighten the belts 56.

Figure 6A:
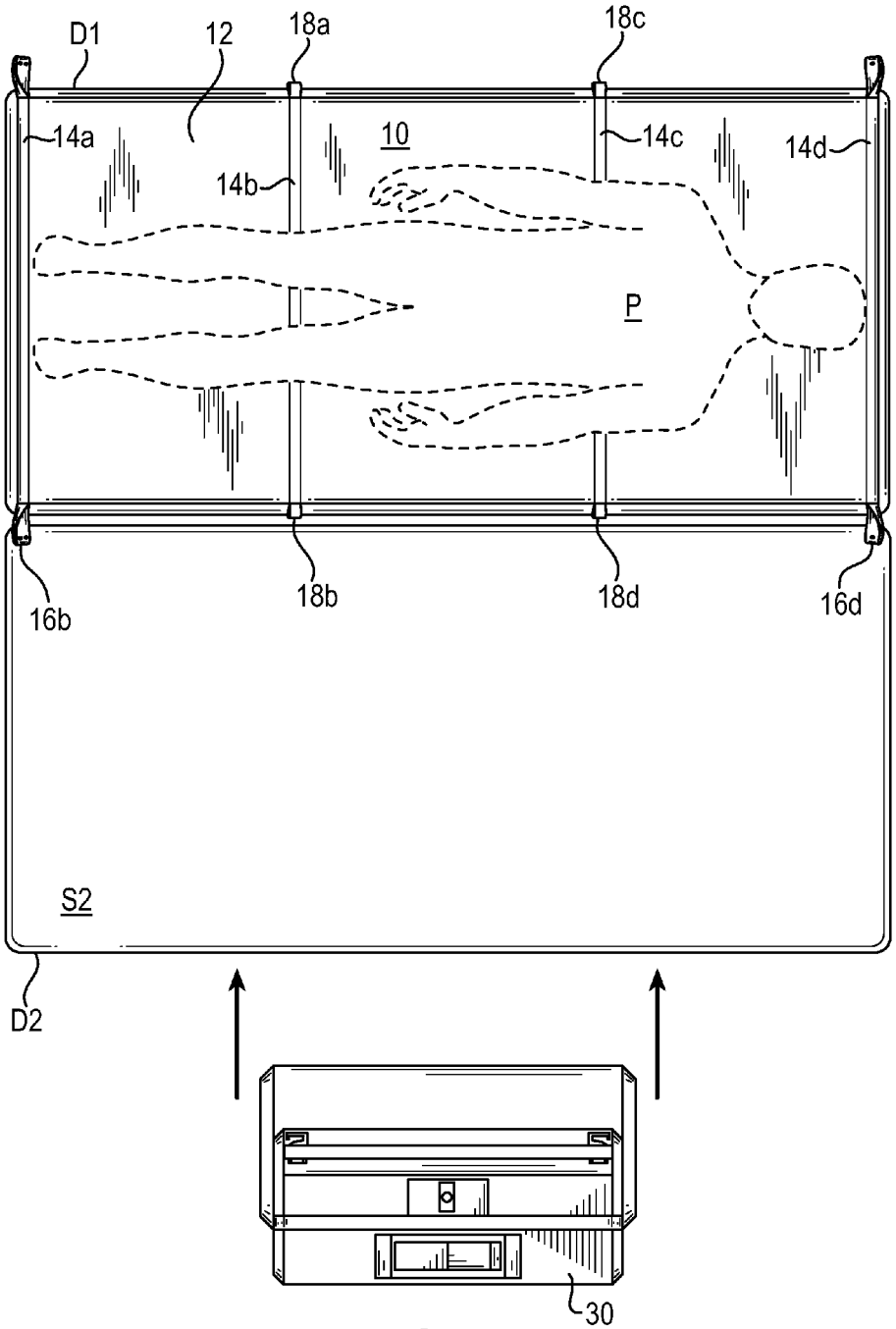
FIGS. 6A-6D illustrate an exemplary method for transferring a patient from a first resting device to a second resting device.
Figure 6B:
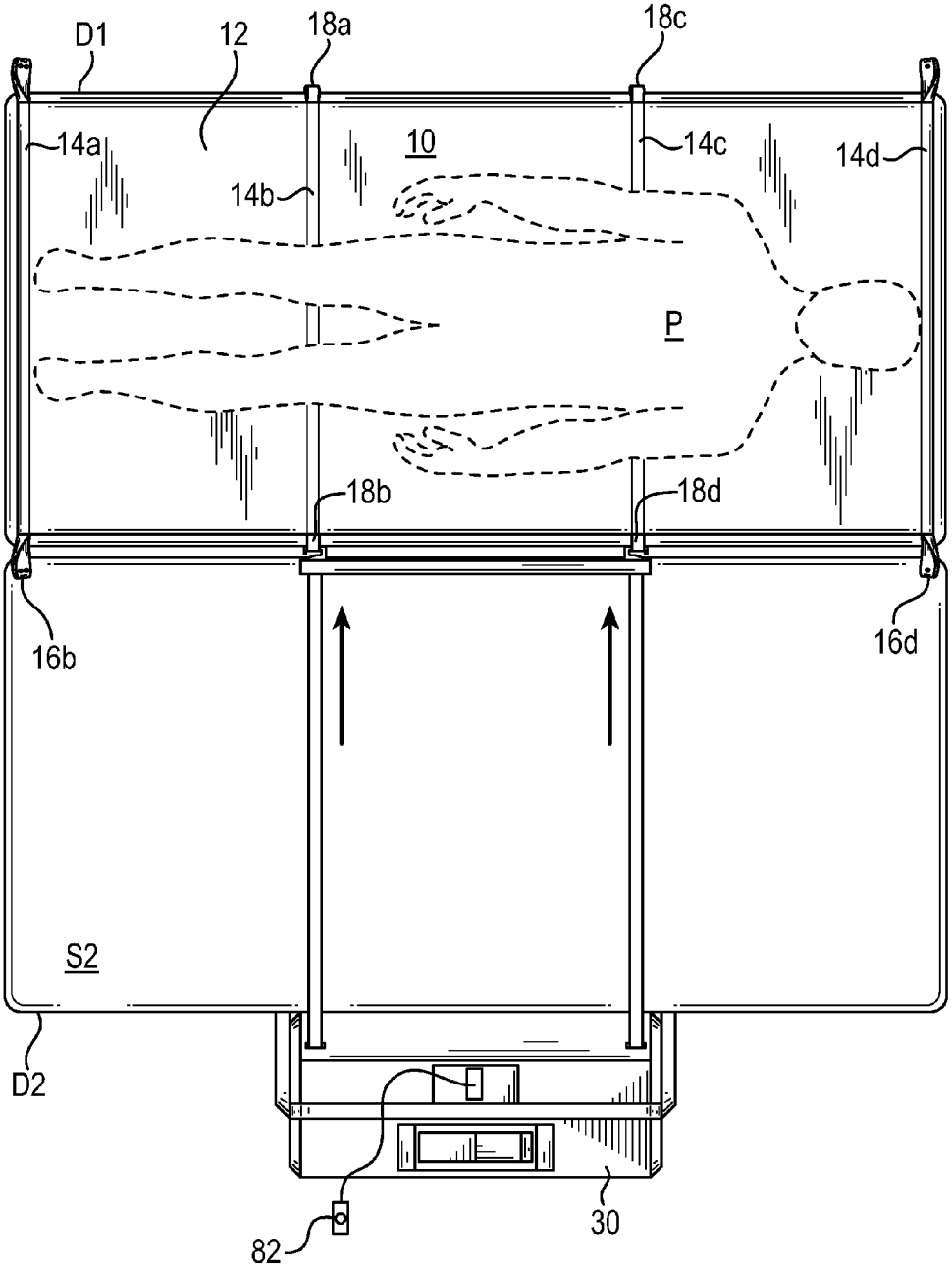
Figure 6C:
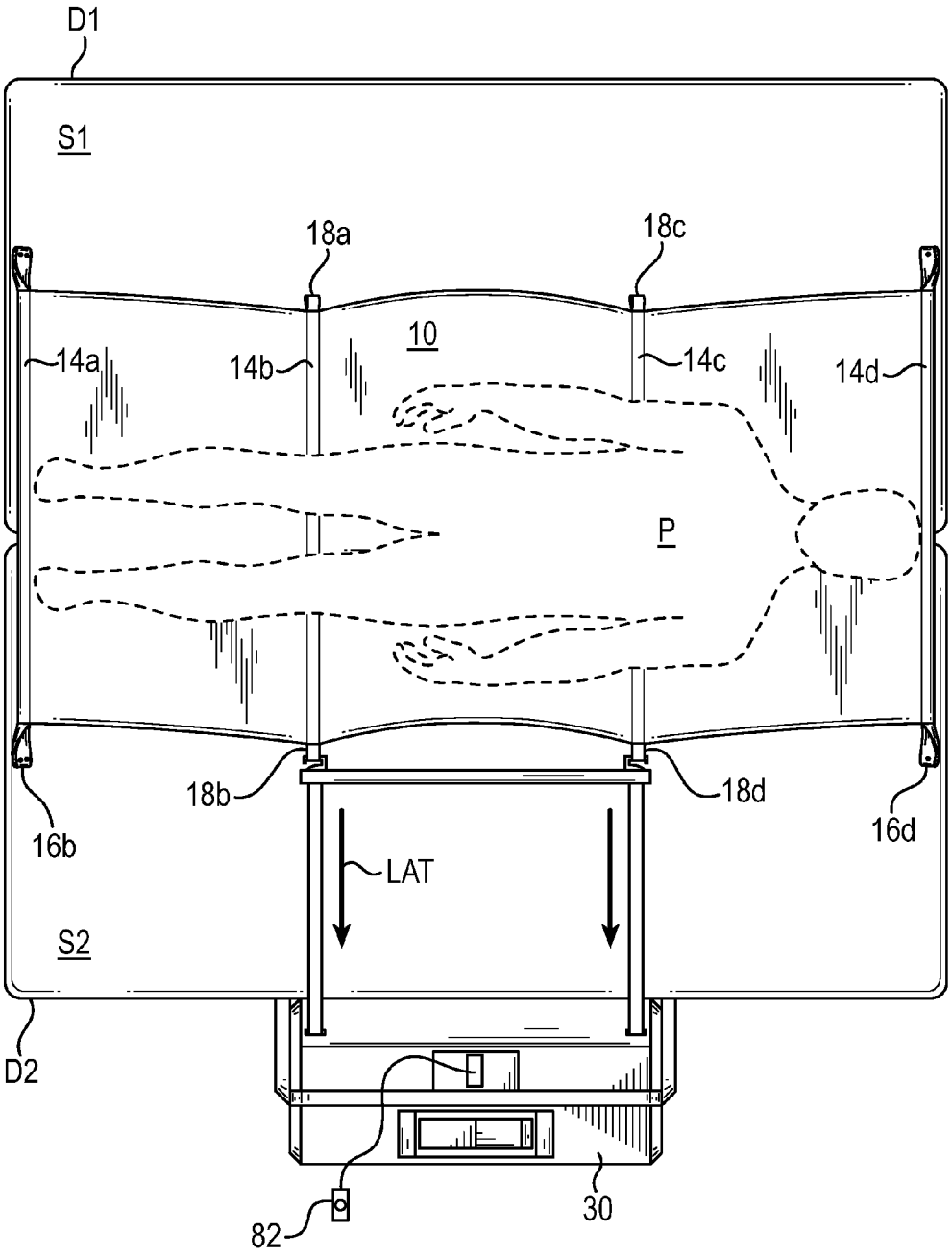
Figure 6D:
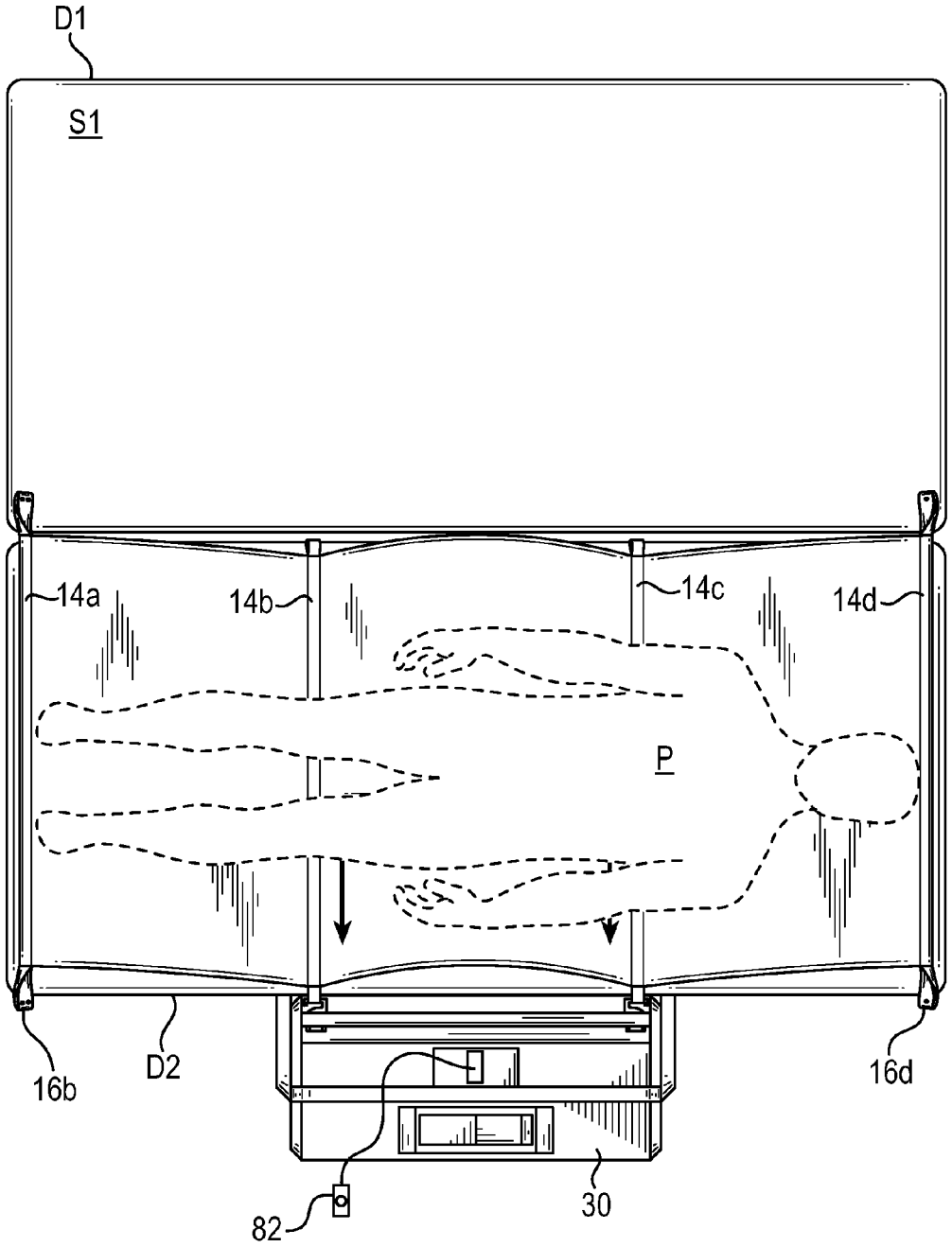

By pressing the correct button on the control 82, the motor 40 is energized. Power is transferred from the motor 40 at the bottom of the patient transfer device 30 to the top of the patient transfer device 30 through the reels 54 and through the pulleys 62 to the sheet 12. Thus, activation of the motor 40 causes the power transfer bar 64 to pull on the sheet 12 for the sheet 12 to slide from the first resting device D1 towards the second resting device D2 while the bumper surface 70 contacts the second resting device D2 thereby transferring the patient P as shown in FIG. 6C. The auto-stop mechanism shuts off the motor when the edge of the sheet 12 reaches a predetermined position past the bumper surface 70 corresponding to a full transfer of the patient P as shown in FIG. 6D.

While example systems, methods, and so on, have been illustrated by describing examples, and while the examples have been described in considerable detail, it is not the intention to restrict or in any way limit the scope of the appended claims to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, and illustrative examples shown or described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (3D. Ed. 1995).

What is claimed is:

1. A method of transferring a patient from a surface of a first resting device to a surface of a second resting device, the method comprising:

inserting a sheet in a corrugated state into a channel between the patient and the surface of the first resting device, wherein the sheet in the corrugated state is corrugated along a first dimension of the sheet corresponding to a longitudinal axis of the patient and the sheet in the corrugated state is inserted into the channel along a transverse axis of the patient perpendicular to the longitudinal axis of the patient;

decorrugating the sheet to a decorrugated state by extending a portion of the sheet in a first direction along the longitudinal axis of the patient between the patient and the surface of the first resting device towards the patient's head and extending another portion of the sheet in a second direction opposite the first direction along the longitudinal axis of the patient between the patient and the surface of the first resting device towards the patient's feet;

engaging the sheet in the decorrugated state to a patient transfer device including a motor; and activating the motor to pull on an edge of the sheet in the decorrugated state in a direction along the transverse axis of the patient to slide the sheet in the decorrugated state relative to the surface of the first resting device thereby transferring the patient to the surface of the second resting device.

2. The method of claim 1, comprising:

transporting the patient transfer device towards the second resting device such that a bumper of the patient transfer device contacts the second resting device; and activating the motor to pull on the edge of the sheet in the decorrugated state in the direction along the transverse axis of the patient while the bumper contacts the second resting device.

3. The method of claim 1, wherein the patient transfer device includes a power transfer bar at least as long as half the length of the sheet, engaging the sheet in the decorrugated state to the patient transfer device includes engaging the sheet in the decorrugated state proximate the power transfer bar, and activating the motor to pull on the edge of the sheet in the decorrugated state in the direction along the transverse axis of the patient transfers power from the motor to a majority of the sheet in the decorrugated state while opposing corrugation of the sheet in the decorrugated state in a longitudinal direction of the sheet in the decorrugated state.

4. The method of claim 1, comprising:

corrugating the sheet prior to inserting the sheet in the corrugated state into the channel, wherein the corrugating includes repeatedly folding the sheet along the first dimension of the sheet into a series of non-overlapping ridges and furrows.

5. The method of claim 1, comprising:

prior to inserting the sheet in the corrugated state into the channel, corrugating the sheet by repeatedly folding the sheet along the first dimension of the sheet into a series of non-overlapping ridges and furrows, and inserting the sheet in the corrugated state into an opening of a bag to form a sheet/bag assembly, wherein inserting the sheet in the corrugated state into the channel includes inserting the sheet/bag assembly into the channel; and after the sheet/bag assembly has been inserted into the channel, pulling on the bag in a direction opposite the opening while retaining the sheet in the corrugated state in place to remove the sheet in the corrugated state from the bag through the opening and to remove the bag from the channel leaving the sheet in the corrugated state in the channel.

6. The method of claim 1, wherein decorrugating the sheet to the decorrugated stated between the patient and the first resting surface includes:

extending a portion of the sheet between the patient and the first resting surface to under the patient's feet by pulling at a first end of the sheet in a first longitudinal direction, and extending a portion of the sheet between the patient and the first resting surface to under the patient's head by pulling at a second end of the sheet opposite the first end in a second longitudinal direction opposite the first longitudinal direction.

7. The method of claim 1, wherein the patient transfer assembly includes handles attached to the sheet at opposite ends of the sheet, wherein the decorrugating the sheet between the patient and the surface of first resting device includes pulling at least one of the handles to extend a portion of the sheet between the patient and the first resting surface to under the patient's feet and pulling of at least one of the handles to extend a portion of the sheet between the patient and the first resting surface to under the patient's head, and the patient transfer assembly includes fasteners attached to or formed on the sheet at at least one side of the sheet, wherein the engaging the sheet in the decorrugated state to the patient transfer device includes engaging the fasteners to the patient transfer device, and the activating the motor to pull on the edge of the sheet in the decorrugated state includes activating the motor to pull on at least one of the fasteners in a direction lateral to the surface of the first resting device to slide the sheet in the decorrugated state relative to the surface of the first resting device thereby transferring the patient to the surface of the second resting device.

8. A method of transferring a patient resting on his/her back from a first resting surface to a second resting surface, the method comprising:

inserting a sheet in a corrugated state into a channel between the patient's lumbar region and the first resting surface, wherein the sheet in the corrugated state is corrugated along a first dimension of the sheet corresponding to a longitudinal axis of the patient and the sheet in the corrugated state is inserted into the channel along a transverse axis of the patient perpendicular to the longitudinal axis of the patient;

decorrugating the sheet to a decorrugated state by extending a portion of the sheet in a first direction along the longitudinal axis of the patient between the patient and the first resting surface from under the patient's lumbar region to under the patient's feet and another portion of the sheet in a second direction opposite the first direction along the longitudinal axis of the patient between the patient and the first resting surface from under the patient's lumbar region to under the patient's head;

engaging the sheet in the decorrugated state to a patient transfer device; and transferring power to the sheet in the decorrugated state to pull on the sheet in the decorrugated state in a direction along the transverse axis of the patient to slide the sheet relative to the first resting surface and the second resting surface thereby transferring the patient to the second resting surface.

9. The method of claim 8, comprising:

corrugating the sheet to the corrugated state prior to inserting the sheet in the corrugated state into the channel, wherein the corrugating includes folding the sheet along the first dimension of the sheet into ridges and furrows.

10. The method of claim 8, comprising:

prior to inserting the sheet in the corrugated state into the channel:

corrugating the sheet by folding the sheet along the first dimension of the sheet into ridges and furrows; and inserting the sheet in the corrugated state into a bag;

wherein inserting the sheet in the corrugated state into the channel includes inserting the bag with the sheet in the corrugated state into the channel.

11. The method of claim 8, comprising:

prior to inserting the sheet in the corrugated state into the channel, corrugating the sheet by folding the sheet along the first dimension of the sheet into ridges and furrows, and inserting the sheet in the corrugated state into an opening of a bag to form a sheet/bag assembly, wherein inserting the sheet in the corrugated state into the channel includes inserting the sheet/bag assembly into the channel; and after the sheet/bag assembly has been inserted into the channel, pulling on a handle of the bag in a direction opposite the opening while retaining the sheet in the corrugated state in place to remove the sheet in the corrugated state from the bag through the opening and to remove the bag from the channel leaving the sheet in the corrugated state in the channel.

12. The method of claim 8, wherein extending the portion of the sheet between the patient and the first resting surface from under the patient's lumbar region to under the patient's feet includes pulling on handles located at a first end of the sheet in a first longitudinal direction, and extending the another portion of the sheet between the patient and the first resting surface from under the patient's lumbar region to under the patient's head includes pulling on handles located at a second end of the sheet opposite the first end in a second longitudinal direction opposite the first longitudinal direction.

13. The method of claim 8, wherein the transferring power to the sheet includes pulling at a side of the sheet such that lateral pulling force is distributed to portions of the sheet on which a majority of the weight of the patient rests.

14. A method of transferring a patient from a first resting surface to a second resting surface, the method comprising:

inserting a sheet in a corrugated state into a channel formed between the patient and the first resting surface, wherein the sheet in the corrugated state is corrugated along a first dimension of the sheet corresponding to a longitudinal axis of the patient and the sheet in the corrugated state is inserted into the channel along a transverse axis of the patient perpendicular to the longitudinal axis of the patient;

decorrugating the sheet to a decorrugated state by:

extending a portion of the sheet in a first direction along the longitudinal axis of the patient between the patient and the first resting surface to under the patient's feet;

extending a portion of the sheet in a second direction opposite the first direction along the longitudinal axis of the patient between the patient and the first resting surface to under the patient's head; and pulling laterally on the sheet in the decorrugated state to slide the sheet from the first resting surface to the second resting surface thereby transferring the patient.

15. The method of claim 14, comprising:

corrugating the sheet to the corrugated state prior to inserting the sheet in the corrugated state into the channel, wherein the corrugating includes repeatedly folding the sheet along the first dimension of the sheet into a series of non-overlapping ridges and furrows.

16. The method of claim 14, comprising:

prior to inserting the sheet in the corrugated state into the channel:

corrugating the sheet to the corrugated state by repeatedly folding the sheet along the first dimension of the sheet into a series of non-overlapping ridges and furrows; and inserting the sheet in the corrugated state into a bag;

wherein inserting the sheet in the corrugated state into the channel includes inserting the bag with the sheet in the corrugated state inside into the channel.

17. The method of claim 14, comprising:

prior to inserting the sheet in the corrugated state into the channel, corrugating the sheet to the corrugated state by repeatedly folding the sheet along the first dimension of the sheet into a series of non-overlapping ridges and furrows, and inserting the sheet in the corrugated state into an opening of a bag to form a sheet/bag assembly, wherein inserting the sheet in the corrugated state into the channel includes inserting the sheet/bag assembly into the channel; and after the sheet/bag assembly has been inserted into the channel, pulling on the bag in a direction opposite the opening while retaining the sheet in the corrugated state in place to remove the sheet in the corrugated state from the bag through the opening and to remove the bag from the channel leaving the sheet in the corrugated state in the channel.

18. The method of claim 14, wherein the channel between the patient and the first resting surface corresponds to at least one of a lumbar region or a lower torso or a lower back region of the patient, and inserting the sheet in the corrugated state into the channel includes identifying the at least one of the lumbar region or the lower torso or the lower back region of the patient in which the sheet in the corrugated state is insertable.

19. The method of claim 14, wherein extending the portion of the sheet between the patient and the first resting surface to under the patient's feet includes pulling at a first end of the sheet in a first longitudinal direction, and extending the portion of the sheet between the patient and the first resting surface to under the patient's head includes pulling at a second end of the sheet opposite the first end in a second longitudinal direction opposite the first longitudinal direction.

20. The method of claim 14, wherein pulling laterally on the sheet to slide the sheet from the first resting surface to the second resting surface includes pulling at a side of the sheet such that lateral pulling force is distributed to portions of the sheet on which a majority of the weight of the patient rests.

21. A method of transferring a patient resting on his/her back from a first resting surface to a second resting surface, the method comprising:

inserting a sheet in a corrugated state into a channel between the patient's lumbar region and the first resting surface, wherein the sheet in the corrugated state is corrugated along a first dimension of the sheet corresponding to a longitudinal axis of the patient and the sheet in the corrugated state is inserted into the channel along a transverse axis of the patient perpendicular to the longitudinal axis of the patient;

decorrugating the sheet to a decorrugated state by extending a portion of the sheet in a first direction along the longitudinal axis of the patient between the patient and the first resting surface from under the patient's lumbar region to under the patient's feet and another portion of the sheet in a second direction opposite the first direction along the longitudinal axis of the patient between the patient and the first resting surface from under the patient's lumbar region to under the patient's head; and pulling laterally on the sheet in the decorrugated state to slide the sheet from the first resting surface to the second resting surface thereby transferring the patient.

22. The method of claim 21, comprising:

corrugating the sheet prior to inserting the sheet in the corrugated state into the channel, wherein the corrugating includes folding the sheet along the first dimension of the sheet into ridges and furrows.

23. The method of claim 21, comprising:

prior to inserting the sheet in the corrugated state into the channel:

corrugating the sheet by folding the sheet along the first dimension of the sheet into ridges and furrows; and inserting the sheet in the corrugated state into a bag;

wherein inserting the sheet in the corrugated state into the channel includes inserting the bag with the sheet in the corrugated state into the channel.

24. The method of claim 21, comprising:

prior to inserting the sheet in the corrugated state into the channel, corrugating the sheet by folding the sheet along the first dimension of the sheet into ridges and furrows, and inserting the sheet in the corrugated state into an opening of a bag to form a sheet/bag assembly, wherein inserting the sheet in the corrugated state into the channel includes inserting the sheet/bag assembly into the channel; and after the sheet/bag assembly has been inserted into the channel, pulling on a handle of the bag in a direction opposite the opening while retaining the sheet in the corrugated state in place to remove the sheet in the corrugated state from the bag through the opening and to remove the bag from the channel leaving the sheet in the corrugated state in the channel.

25. The method of claim 21, wherein extending the portion of the sheet between the patient and the first resting surface from under the patient's lumbar region to under the patient's feet includes pulling on handles located at a first end of the sheet in a first longitudinal direction, and extending the another portion of the sheet between the patient and the first resting surface from under the patient's lumbar region to under the patient's head includes pulling on handles located at a second end of the sheet opposite the first end in a second longitudinal direction opposite the first longitudinal direction.

26. The method of claim 21, wherein pulling laterally on the sheet to slide the sheet from the first resting surface to the second resting surface includes pulling at a side of the sheet such that lateral pulling force is distributed to portions of the sheet on which a majority of the weight of the patient rests.

* * * * *